US010927648B2

(12) United States Patent
Stang et al.

(10) Patent No.: US 10,927,648 B2
(45) Date of Patent: Feb. 23, 2021

(54) APPARATUS AND METHOD FOR ABRASIVE PERFORATING AND CLEAN-OUT

(71) Applicant: Stang Technologies Ltd., Macklin (CA)

(72) Inventors: Jonathan M. Stang, Macklin (CA); Daryl E. Magner, Arvada, CO (US)

(73) Assignee: Stang Technologies Ltd., Macklin (CA)

( * ) Notice: Subject to any disclaimer, the term of this patent is extended or adjusted under 35 U.S.C. 154(b) by 0 days.

(21) Appl. No.: 16/698,858

(22) Filed: Nov. 27, 2019

(65) Prior Publication Data

US 2020/0115997 A1 Apr. 16, 2020

Related U.S. Application Data

(63) Continuation-in-part of application No. 16/686,955, filed on Nov. 18, 2019, which is a (Continued)

(51) Int. Cl.
*E21B 43/112* (2006.01)
*E21B 43/114* (2006.01)

(52) U.S. Cl.
CPC ..... *E21B 43/114* (2013.01); *E21B 43/112* (2013.01)

(58) Field of Classification Search
CPC ..... E21B 21/00; E21B 23/006; E21B 29/002; E21B 34/10; E21B 37/00; E21B 37/08; (Continued)

(56) References Cited

U.S. PATENT DOCUMENTS 2,034,768 A 3/1936 O'Neill
4,804,044 A 2/1989 Wesson et al.
(Continued)

FOREIGN PATENT DOCUMENTS

RU 2185497 C1 7/2002
RU 164401 U1 8/2016

OTHER PUBLICATIONS

International Search Report and Written Opinion of co-pending International Application No. PCT/US2020/018143; Report dated Jun. 8, 2020; 14 pages.
(Continued)

*Primary Examiner* — Daniel P Stephenson
(74) *Attorney, Agent, or Firm* — Peter L. Brewer; Thrive IP

(57) ABSTRACT

A perforating tool and method of use in a wellbore. The perforating tool is placed at the end of a coiled tubing or other conveyance string. The perforating tool comprises a tubular housing providing an elongated bore through which fluid flows. The tubular housing has jetting ports used for hydraulic perforating. The tool operates in a flow-through mode when working fluid is pumped into the tubular housing at a first flow rate, with all of the fluid flowing through the end of the tool. The perforating tool operates in a perforating mode when the working fluid is pumped into the bore of the tubular housing at a second flow rate. In this mode, all of the working fluid flows through the jetting ports. The perforating tool may include a sequencing mechanism responsive to a sequence of flow rates to cycle the tool through operating modes.

48 Claims, 20 Drawing Sheets

Related U.S. Application Data continuation-in-part of application No. 16/280,364, filed on Feb. 20, 2019.

(60) Provisional application No. 62/902,471, filed on Sep. 19, 2019, provisional application No. 62/939,341, filed on Nov. 22, 2019, provisional application No. 62/778,384, filed on Dec. 12, 2018, provisional application No. 62/677,023, filed on May 27, 2018.

(58) Field of Classification Search
CPC .. E21B 41/0078; E21B 4/02; E21B 2034/007; E21B 2200/06
See application file for complete search history.

(56) References Cited

U.S. PATENT DOCUMENTS 5,335,731 A 8/1994 Ringgenberg et al.
5,529,126 A 6/1996 Edwards
5,890,542 A 4/1999 Ringgenberg
5,984,014 A 11/1999 Poullard
6,109,354 A 8/2000 Ringgenberg et al.
6,289,999 B1 * 9/2001 Dewey ..... E21B 23/006 175/38
6,659,186 B2 12/2003 Patel
6,668,948 B2 * 12/2003 Buckman, Sr. ..... B05B 1/3447 175/393
6,874,579 B2 4/2005 Johnson
6,889,771 B1 5/2005 Leising et al.
7,090,020 B2 8/2006 Hill
7,168,491 B2 1/2007 Malone et al.
7,213,648 B2 5/2007 Hayes et al.
7,357,198 B2 4/2008 Mcgarian et al.
7,568,525 B2 8/2009 Veselkov
7,644,774 B2 1/2010 Branch
7,814,978 B2 10/2010 Steele et al.
8,276,677 B2 10/2012 Ravensbergen
8,312,925 B2 11/2012 Trummer et al.
8,490,702 B2 7/2013 Stromquist et al.
8,931,557 B2 * 1/2015 Patterson ..... E21B 34/14 166/308.1
8,967,300 B2 * 3/2015 Dewey ..... E21B 10/322 175/269
8,978,784 B2 3/2015 Miszewski
8,985,227 B2 * 3/2015 Nikiforuk ..... E21B 33/16 166/386
9,115,558 B2 8/2015 Stang
9,145,748 B1 9/2015 Meier et al.
9,494,014 B1 11/2016 Manke
9,845,641 B2 * 12/2017 Belew ..... E21B 10/61
2002/0062963 A1 5/2002 Eslinger et al.
2004/0129423 A1 7/2004 Eddison
2007/0284106 A1 12/2007 Kalman et al.
2009/0250224 A1 10/2009 Wright et al.
2012/0205108 A1 8/2012 Stang
2013/0031615 A1 * 1/2013 Woodward ..... H04W 8/02 726/4
2014/0008071 A1 1/2014 Patterson et al.
2014/0069648 A1 3/2014 Dotson et al.
2014/0158357 A1 6/2014 Lyashkov et al.
2014/0182699 A1 * 7/2014 Manson ..... E21B 21/00 137/15.05
2014/0262263 A1 9/2014 Yudin et al.
2014/0262321 A1 * 9/2014 Fripp ..... E21B 43/12 166/373
2015/0159468 A1 * 6/2015 Mailand ..... E21B 34/14 166/297
2015/0275641 A1 10/2015 Watson et al.
2016/0053592 A1 2/2016 Getzlaf et al.
2016/0160619 A1 * 6/2016 Randall ..... E21B 7/061 166/55.1
2016/0326834 A1 * 11/2016 Manke ..... E21B 21/103
2017/0159406 A1 6/2017 Flores Perez
2017/0260838 A1 9/2017 Livescu et al.
2018/0252078 A1 9/2018 Schultz
2019/0360308 A1 * 11/2019 Stang ..... E21B 4/02
2020/0087999 A1 * 3/2020 Stang ..... E21B 37/00
2020/0115997 A1 * 4/2020 Stang ..... E21B 1/00

OTHER PUBLICATIONS

International Search Report of co-pending International Application No. PCT/IB2020/000437; Report dated Oct. 22, 2020; 6 pages.
International Written Opinion of co-pending International Application No. PCT/IB2020/000437; Report dated Oct. 22, 2020; 7 pages.
Machine translation of RU2185497C1; 6 pages.
Machine translation of RU164401U1; 5 pages.

* cited by examiner

APPARATUS AND METHOD FOR ABRASIVE PERFORATING AND CLEAN-OUT

STATEMENT OF RELATED APPLICATIONS

This application claims the benefit of U.S. Ser. No. 62/902,471 entitled "Apparatus and Method for Abrasive Perforating and Clean-Out." That application was filed on Sep. 19, 2019.

This application also claims the benefit of U.S. Ser. No. 62/939,341 also entitled "Apparatus and Method for Abrasive Perforating and Clean-Out." That application was filed on Nov. 22, 2019.

The application is also filed as a continuation-in-part to U.S. Ser. No. 16/686,955 filed Nov. 18, 2019. That application is entitled "Multi-Cycle Wellbore Clean-Out Tool."

The '955 application was itself filed as a continuation-in-part to U.S. Ser. No. 16/280,364. That application was filed Feb. 20, 2019 and is also entitled "Multi-Cycle Wellbore Clean-Out Tool."

The '364 application claims the benefit of U.S. Ser. No. 62/778,384 filed on Dec. 12, 2018 and U.S. Ser. No. 62/677,023 filed May 27, 2018.

Each of these applications is incorporated herein in its entirety by reference

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the invention relates to wellbore completions and remediation operations. Further still, the invention relates to a tool that may be connected to a string of coiled tubing (or other working string) and used for wellbore clean-out.

Discussion of Technology

During the course of a well operation, it is sometimes desirable to clean out the wellbore. For example, after a well is completed and before a string of production tubing is hung, the operator may wish to run a clean-out tool down the hole to circulate out cement chips, sand, and other debris. In addition, it is sometimes desirable to clean out a producing well that has become filled with sand. Such incidents may occur because the well is producing from an unconsolidated formation, or due to a poorly designed fracturing operation.

In either of these instances, a simple nozzle may be run into a wellbore at the end of a coiled tubing string. A coiled tubing connector may be used to connect the coiled tubing string with the nozzle. An aqueous circulating fluid is pumped down the working string, through the nozzle and then up the back side (or annulus) of the working string. Preferably, a surfactant, an acid or other chemical is injected down the coiled tubing string following the aqueous circulating fluid as part of the clean-out.

A separate type of tool that also involves circulating fluid down a working string is an abrasive perforating tool. Abrasive perforating tools utilize custom lateral jetting ports that allow a fluid containing abrasive particles, e.g., sand, to be pumped downhole through the working string at high pressures and then out of the jetting ports. The abrasive fluid erodes through the surrounding casing at a designated depth, then through the cement and out into the surrounding rock formation. This is an alternative to explosive charge perforating and the use of detonators and gun barrels.

Some abrasive perforating tools frequently offer a clean-out function using reverse circulation. In one aspect, an abrasive perforating tool may be part of a bottom hole assembly containing a reverse ball check valve. The BHA components include a CT connector, a disconnect, a stabilizer, an abrasive cutting sub having at least one jetting nozzle, the reverse ball check valve, and then the nozzle. A schematic view of such a device is shown in FIG. 1 of U.S. Pat. No. 9,115,558.

The reverse ball check valve of the '558 patent includes a pin and a ball. When fluid is pumped down the coiled tubing, the reverse ball check valve is forced closed, preventing fluid from exiting the nozzle at the bottom of the BHA. Fluid is then directed through the lateral jetting ports for hydraulic perforating. Subsequently, when sand or other particulates are required to be cleaned out, a "reverse clean-out" procedure is conducted.

To perform the reverse clean-out, an aqueous fluid is injected down the back side of the coiled tubing. The fluid is pumped downhole where it then flows back up the BHA, through the reverse ball check valve, through the bore of the coiled tubing string and to the surface. The fluid returns will include the abrasive fluid used in the perforating process. A somewhat schematic reverse clean-out flow for a BHA having a known reverse ball check valve is shown in FIG. 2 of the same '558 patent.

As described in greater detail in the '558 patent, the use of reverse flow clean-out valves is often impractical in connection with horizontal wellbores. This is because of the significant likelihood of fill material gathering around the outer diameter of the BHA during the reverse circulation phase. In this respect, the BHA cannot take advantage of gravity to bring the fill material down to the nozzle as is present in a vertical well. Depending on the size of the wellbore, the length of the horizontal leg of the well and the cleanout medium used, the annular velocity (governed by gauge pressure at the surface) likely will not be high enough to sweep the entire fill to the end of the bottom hole assembly.

Due to this limitation, the '558 patent disclosed a novel abrasive perforating tool capable of being cycled during pumping operations to provide clean-out. This allows for a multi-cycle adjustment of tool function carried out by manipulating pumping rates. The '558 patent is incorporated herein it its entirety by reference.

The abrasive perforating tool of the '558 patent utilizes a plunger that is moved up and down in response to pumping rates applied at the surface. Depending on the pumping mode, the tool operates in either a flow-through mode where the plunger resides above a seat, or a perforating mode, where the plunger lands on the seat. In the flow-through mode, working fluids are circulated around the plunger, through the seat, and then back up the wellbore along the back side of the coiled tubing string. In the perforating mode, all fluids are forced through lateral nozzles and are directed against the surrounding casing. Beneficially, fluids can be pumped down the bore of the working string and through an end nozzle in the same direction for both abrasive perforating and for clean-out, using a cycling mechanism.

A need exists for an improved abrasive perforating tool that operates with a similar cycling mechanism for wellbore clean-out, but wherein a feature is provided to ensure that circulating fluids do not exit the tool through the lateral nozzles while the tool is in its flow-through mode. Stated another way, a need exists for a multi-cycle wellbore perforating tool that does not offer, as an option, split flow. A need further exists for a method of cleaning out a well, wherein a positive displacement motor is disposed below a perforating tool, with the motor taking advantage of a full flow of fluids moving through the seat during a flow-through mode.

SUMMARY OF THE INVENTION

An abrasive perforating tool for controlling a direction of an injected fluid within a wellbore is first provided herein. The perforating tool is configured to cycle between a flow-through mode wherein all fluid is pumped under pressure through the tool and then circulated back up to the surface on the back side of the tool, and a perforating mode wherein an abrasive fluid is pumped under pressure into the tool and through lateral jetting ports to cut or "perforate" a surrounding casing string.

The perforating tool first includes a tubular housing. The tubular housing defines a series of tubular bodies threadedly connected end-to-end. The tubular housing provides an elongated bore through which fluid may flow. The tubular housing includes one or more jetting ports disposed there along. The jetting ports are designed to receive the abrasive fluid when the tool is in a perforating mode.

The perforating tool also includes a piston. The piston defines a short cylindrical body that is disposed at an upstream end of the housing. The piston has an orifice configured to deliver fluids from a wellbore conveyance tubing to the elongated bore of the housing. Of interest, the piston forms a pressure shoulder as fluids are injected through the conveyance tubing.

The perforating tool additionally includes a tubular mandrel. The tubular mandrel is slidably positioned within the housing. The mandrel has a proximal end connected to or otherwise acted upon by the piston, and a distal end comprising a plunger. In one embodiment, the plunger is a separate body threadedly connected to the distal end of the mandrel.

As part of the tubular housing, The perforating tool may comprise a spring housing. The spring housing has an internal shoulder that supports a spring. An upper end of the spring acts against the piston, biasing the piston and connected mandrel in the raised position. This is a flow-through mode.

The perforating tool further includes a seat. The seat is disposed along the tubular housing below the distal end of the tubular mandrel. The seat is dimensioned to receive the plunger when the piston and connected tubular mandrel slide from a raised position to a lowered position along the tubular housing. Of interest, the seat provides a central flow-through opening through which fluids flow when the tool is in its flow-through mode.

Preferably, the tubular housing further includes an upper sub having a first upper end and a second lower end, wherein the lower end is threadedly connected to an upper end of the spring housing. Preferably, the tubular housing also includes a lower sub having a first upper end and a lower end, with the lower end being threadedly connected to a downhole rotary tool.

In one aspect, the wellbore clean-out tool further comprises:

- an annular region formed between the mandrel and the surrounding tubular housing;
- one or more slots residing along the mandrel;
- one or more flow ports also residing along the mandrel, but below the slots;
- an upper seal residing along an inner diameter of the tubular housing; and
- a separate lower seal also residing along the inner diameter of the tubular housing, wherein the upper and lower seals straddle the jetting ports.

When the perforating tool is in its raised position, pumped fluid exits the mandrel through the flow ports, but the lower seal prevents the pumped fluid from flowing all the way up the annular region and to the jetting ports, thereby forcing all of the fluid to flow around the plunger and through the seat. Reciprocally, when the perforating tool is in its lowered position, abrasive fluid exits the mandrel through the slots, with the abrasive fluid being confined by the upper and lower seals to flow through the jetting ports.

The perforating tool is configured to cycle a position of the mandrel and connected plunger in response to fluid pumping rate into the wellbore. Preferably, the tool is configured to cycle between two operating modes—a flow-through (or a clean-out) mode and a perforating mode. All fluid flows through the flow-through opening in the seat when the mandrel and connected plunger are in the raised position, which is the flow-through mode. Reciprocally, all fluid flows through the jetting ports when the mandrel and connected plunger are in the lowered position, which is the abrasive perforating position.

In one embodiment, a positive displacement motor is disposed below the tubular housing as the rotary tool. The positive displacement motor is operatively connected to the lower sub at its distal end. The positive displacement motor, in turn, is connected to a milling tool or a drill bit.

In the flow-through mode, fluid is pumped into the bore of the tubular housing at a first flow rate. In this mode, all of the pumped fluid flows into the mandrel, through flow ports located along the mandrel, around the plunger, and then through the flow-through opening in the seat.

In the perforating mode, the fluid is pumped into the bore of the tubular housing at a second higher flow rate. In this mode, all of the pumped fluid flows into the mandrel, through the slots located along the mandrel, and then through the jetting ports. In this instance, the pumped fluid is preferably mixed with sand, forming an abrasive perforating fluid.

In the preferred embodiment, the mandrel and connected plunger remain in a raised position during run-in. The plunger is maintained a sufficient distance above the seat to permit fluid to travel through the flow ports in the mandrel and through the seat below. Once the pump rate is raised to an activation rate (referred to in some instances herein as the "second flow rate"), the plunger is lowered onto the seat, providing for the perforating mode. The upper and lower seals serve to direct flow in the two modes, ensuring that there is no split flow.

To facilitate the cycling of injection modes, the abrasive perforating tool may also include a sequencing mechanism. The sequencing mechanism is responsive to a sequence of pump rates applied above the piston. In one aspect, the sequencing mechanism comprises a cylindrical body configured to cycle the mandrel between its flow-through mode (wherein all fluid flows through the seat at the end of the tool) and its perforating mode (wherein all fluid is directed laterally through the jetting ports). In one aspect, an intermediate position is provided wherein the mandrel and connected plunger reside between the raised position and the lowered position but the mandrel remains in its flow-through mode.

Preferably, the sequencing mechanism is a J-slot sequencing mechanism. The J-slot mechanism will cooperate with one or perhaps two pins that are disposed along the tubular housing as a J-slot collar. The pins are configured to ride in slots along the J-slot mechanism to cycle the mandrel and connected plunger between the raised position and the lowered position. In this instance, the pins are fixed from axial movement and ride in the slots of the J-slot channel of the mandrel to restrict axial movement of the mandrel on alternating downward strokes.

A method of operating an abrasive perforating tool in a wellbore is also provided. The method first includes running a multi-cycle perforating tool into the wellbore. The perforating tool is run in on a lower end of a string of coiled tubing. The perforating tool is arranged in accordance with the perforating tool as described above, in any of its embodiments.

The method additionally includes locating the perforating tool at a selected depth along the wellbore. In one aspect, the wellbore has been completed with a string of production tubing. In this instance, the perforating tool is run into the production tubing in order to clean out fill that may have accumulated within the production tubing and casing. More preferably, the perforating tool is run into production casing during well completion, enabling the tool to both mill out plugs or clean out wellbore debris, and perforate casing. It is observed that the tool is particularly suited for clean-out operations or tool setting operations along a horizontal section of a wellbore.

The method further includes pumping a working fluid down the coiled tubing and into the bore of the tubular housing. This injection is done at a first flow rate. This injection causes the pumped fluid to flow through the bore of the tubular housing, out of the mandrel through radial flow ports and into the annular area, around the plunger, and then through the flow-through opening in the seat. In other words, the pumped fluid flows entirely through the end of the tool. This is a flow-through mode.

The method also includes further pumping the working fluid down the coiled tubing and into the bore of the tubular housing at a second flow rate. Here, the second flow rate is higher than the first flow rate. This increases a hydraulic force acting on the pressure shoulder of the piston, and causes the mandrel and connected plunger to slide downward along the tubular housing.

As the mandrel and connected plunger move down the tubular housing, the plunger will land on the seat, sealing flow through the flow-through opening. In this position, the fluid will flow down the mandrel, through slots in the mandrel and into the annular area, and then through the lateral jetting ports. This is a perforating mode. Of interest, in this position the upper and lower seals confine the fluid so that all working fluid exits the tool through the lateral jetting ports. In this mode, the pumped fluid will likely include sand.

In one aspect, the perforating tool employs a sequencing mechanism to cycle the tool between positions. Preferably, the sequencing mechanism is a so-called J-slot mechanism. In one aspect, the J-slot mechanism has slots that cycle the plunger between the flow-through mode and the perforating mode. Specifically, the J-slot mechanism is configured to:

(i) maintain the perforating tool in its raised position while pumping at or below the first pump rate, placing the perforating tool in its flow-through mode wherein all of the pumped fluid flows through the bottom of the tool;

(ii) maintain the perforating tool in an intermediate position while increasing pump rate above the first pump rate (which may meet or exceed a second pump rate), and wherein all of the pumped fluid continues to flow through the mandrel and out of the bottom of the tool;

(iii) upon dropping the pump rate back down to or below the first pump rate, allowing the spring to move the perforating tool back to its raised position, which again is the flow-through mode;

(iv) upon raising the pump rate to a rate that meets or exceeds the second pump rate, move the perforating tool to its lowered position, placing the perforating tool in its perforating mode wherein all pumped fluid is forced through the lateral jetting nozzles; and (v) repeat the cycle of steps (i) through (iv), such as at a different depth.

A second embodiment of a perforating tool is also provided herein. The perforating tool is again used for controlling a direction of a working fluid within a wellbore, with the wellbore having been lined with a string of production casing. In this embodiment, the perforating tool comprises:

a tubular housing providing an elongated bore through which fluids may be injected, the tubular housing having one or more lateral jetting ports;

a piston disposed proximate an upstream end of the housing, the piston forming a pressure shoulder and having an orifice configured to deliver the working fluid from a wellbore conveyance tubing into the elongated bore of the housing;

a tubular mandrel slidably positioned within the housing, the mandrel having a proximal end connected to or acted upon by the piston, and a distal end forming a plunger;

one or more flow ports; and a seat disposed along the tubular housing and having a through-opening, the through-opening being configured to slidably receive the plunger when the piston and connected mandrel slide from a raised position to a lowered position along the tubular housing.

In this arrangement, the perforating tool is configured to cycle a position of the mandrel and connected plunger in response to changes in fluid pumping rate into the conveyance tubing. The tool is biased to an abrasive perforating position such that (i) all working fluid flows through the flow ports in the mandrel and out of the lateral jetting ports in the tubular housing above the seat when the mandrel and connected plunger are in the raised position. In response to an increase in pump rate (ii) all working fluid flows through the flow ports and out of the tubular housing below the seat when the mandrel and connected plunger are in the lowered position.

The plunger comprises a solid body that is operatively connected to the distal end of the mandrel. Preferably, the perforating tool further comprises a stem wherein an upper end of the stem is threadedly connected to a lower end of the mandrel, and the plunger resides at a lower end of the stem. In this instance, the one or more flow ports comprises two or more flow ports radially disposed around the stem proximate to and above the plunger.

In one aspect, the tubular housing comprises a spring housing having an internal shoulder. The perforating tool then further comprises a spring residing within the spring housing, with an upper end of the spring acting against the piston, biasing the tool in its raised position.

In one arrangement, the tubular housing further comprises an upper sub having a first upper end and a second lower end, wherein the lower end is threadedly connected to an upper end of the spring housing, and a lower sub having a first upper end and a lower end, with the lower end being threadedly connected to a downhole tool. In this way, the perforating tool is part of a larger bottom hole assembly, or BHA.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1A:
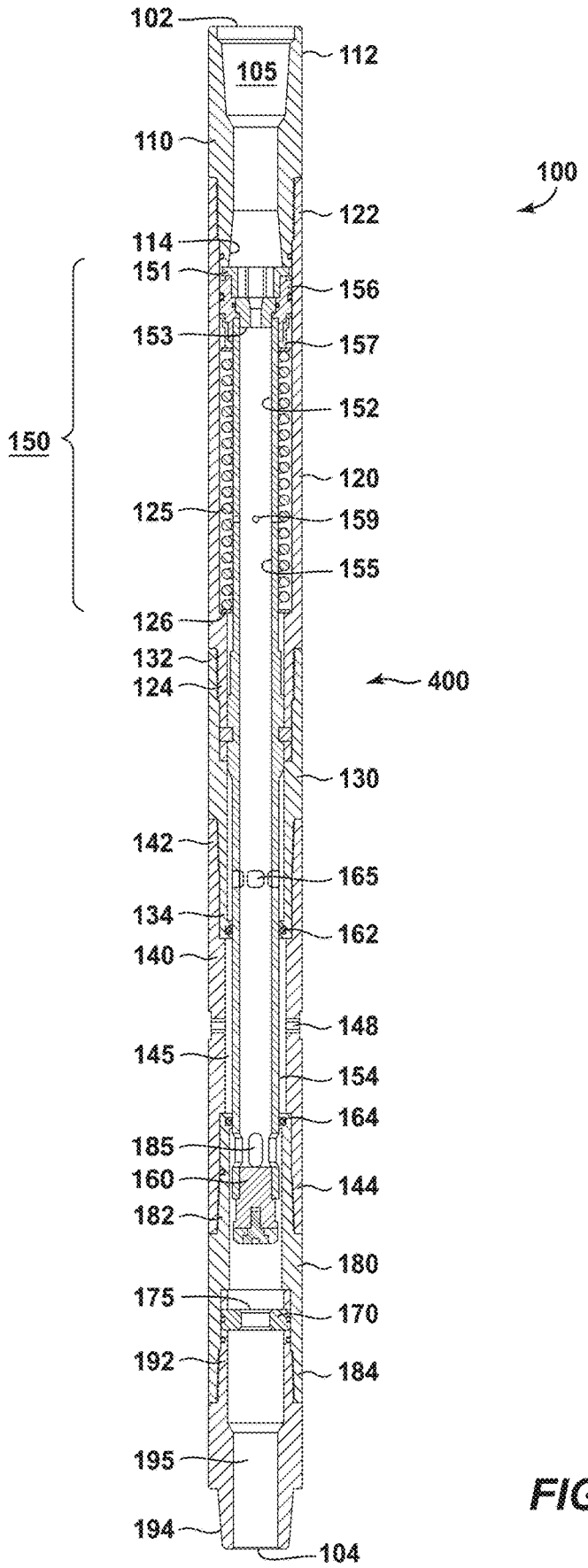
FIG. 1A is a first cross-sectional view of a perforating tool (or "flow diverter") of the present invention, in one embodiment. In this view, the perforating tool is in its run-in position. A plunger is in a raised position, allowing injected fluids to flow through a flow-through opening at the bottom of the tool.

For purposes of the present application, it will be understood that the term "hydrocarbon" refers to an organic compound that includes primarily, if not exclusively, the elements hydrogen and carbon. Examples of hydrocarbon-containing materials include any form of oil, natural gas, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" generally refers to gases, liquids, and combinations of gases and liquids, as well as to combinations of gases and fines, combinations of liquids and fines, and combinations of gases, liquids, and fines.

As used herein, the term "wellbore fluids" means water, hydrocarbon fluids, formation fluids, or any other fluids that may be within a wellbore during a production operation.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. The term "well," when referring to an opening in the formation, may be used interchangeably with the term "wellbore."

As used herein, the term "subsurface" refers to geologic strata occurring below the earth's surface.

The terms "zone" or "zone of interest" refer to a portion of a formation containing hydrocarbons. Sometimes, the terms "target zone," "pay zone," or "interval" may be used.

As used herein, the terms "working fluid" and "clean-out fluid" refer to any fluid that may be pumped into a wellbore in connection with a downhole flow-diverter tool. Such fluids may include aqueous fluids, fluids containing an abrasive material used for perforating casing, a hardware treating fluid, or a fluid containing a surfactant.

The terms "tubular" or "tubular member" refer to any pipe, such as a joint of casing, a portion of a liner, a joint of tubing, a pup joint, or coiled tubing. The terms "production tubing" or "tubing joints" refer to any string of pipe through which reservoir fluids are produced.

Description of Specific Embodiments

The present disclosure relates to hydraulic clean-out operations for pipe. The tools and methods disclosed herein are ideally suited for wellbore operations, including using the perforating tool in combination with a downhole positive displacement motor and mill bit.

FIG. 1A is a cross-sectional view of a wellbore clean-out tool 100 of the present invention, in one embodiment. In some cases herein, the perforating tool 100 may be referred to as a flow diverter. The perforating tool 100 is used to inject fluids into a wellbore for clean-out and for abrasive perforating. An illustrative wellbore is shown at 1000 in FIG. 10 and is discussed below.

The perforating tool 100 defines a generally tubular body formed from a series of components. As shown, the perforating tool 100 has a first (or upstream) end 102 and a second (or downstream) end 104. A central bore 105 is formed within the body extending from the first end 102 to the second end 104.

As will be discussed, the perforating tool 100 is configured to cycle or otherwise move a position of a mandrel 155 and a connected plunger 160 within the tubular body, in response to fluid pumping rates into the wellbore 1000 by an operator. In this way, a flow of working fluid through the tool 100 may be adjusted. In the view of FIG. 1A, the perforating tool 100 is in its run-in position wherein all of the injected fluid flows through the tool 100 from the top (or upstream) end 102 to the bottom (or downstream) end 104 en route to a next downhole tool or to the bottom of the wellbore 1000 or to a plug, as the case may be. Specifically, the fluid will flow into the bore 105, out of the mandrel 155 through side ports 185, then through an annular area 145 around the plunger 160, and through a seat 170.

Of interest, a lower seal 164 resides along a lower mandrel seal sub 160 and inside of a jetting port housing 140. This is just above the flow ports 185. A seal 164 prevents working fluids from flowing up the annular area 145 to a level of lateral jetting nozzles (or jetting ports) 148 when the tool 100 is in its flow-through mode.

The perforating tool 100 is comprised of a series of tubular bodies that are threadedly connected end-to-end. A first of these represents a top sub 110. The top sub 110 defines a tubular body wherein a first (or upstream) end 112 comprises female threads while a second (or downstream) end 114 comprises male threads. The female threads are configured to threadedly connect to a CT connector (not shown), which in turn is connected to a string of coiled tubing (or other conveyance medium).

The perforating tool 100 next includes a spring housing 120. The spring housing 120 also defines a generally tubular body wherein a first end 122 comprises female threads while a second opposite end 124 comprises male threads. The first end 122 of the spring housing 120 threadedly connects to the second (or downstream) end 114 of the top sub 110.

The perforating tool 100 also includes a spring 125. The spring 125 resides along an inner diameter of the spring housing 120. The spring 125 is held in compression within the tool 100. In one aspect, the spring 125 is an Inconel® spring. Alternatively, the spring material is 17-7 stainless steel. Of interest, a shoulder 126 resides along an inner diameter of the spring housing 120. The shoulder 126 serves as a face against which the spring 125 resides.

Moving down the tool 100, the perforating tool 100 next includes an upper mandrel seal sub 130. The upper mandrel seal sub 130 also defines a generally tubular body wherein a first (or upstream) end 132 comprises female threads while a second opposite (or downstream) end 134 comprises male threads. The upstream end 132 threadedly connects to the second (or downstream) end 124 of the spring housing 120. Of interest, the upper mandrel seal sub 130 encompasses a sequencing mechanism 400, discussed below.

The perforating tool 100 also comprises a jetting port housing 140. The jetting port housing 140 also defines a generally tubular body wherein a first (or upstream) end 142 comprises female threads while a second (or downstream) opposite end 144 also comprises female threads. The jetting port housing 140 resides downstream from the upper mandrel seal sub 130. Specifically, the first end 142 of the jetting port housing 140 threadedly connects to the second end 134 of the upper mandrel seal sub 130.

Of importance, the jetting port housing 140 comprises one or more jetting ports 148. Preferably, the jetting ports 148 are placed within the jetting port housing 140 at a 90° angle, or transverse to a longitudinal axis of the tool 100. In this way, when the tool 100 is in its perforating mode, jetting fluid may exit the jetting port housing 140 directly at the surrounding casing to be perforated. Preferably, a plurality of lateral jetting ports 148 are placed radially around the jetting port housing 140 along at least two levels.

As a next component, the perforating tool 100 includes a lower mandrel seal sub 180. The lower seal sub 180 defines a generally tubular body that is essentially a mirror image of the upper mandrel seal sub 130. Seal subs 130 and 180 are the same component, but with sub 160 being turned upside down. An upper end 182 of the lower seal sub 180 is threadedly connected to the lower end 144 of the jetting port housing 140.

Below the lower seal sub 180 is a bottom sub 190. The bottom sub 190 also defines a tubular body having an upper end 192 and a lower end 194. The upper end 192 comprises male threads that connect to a female bottom end 184 of the lower mandrel seal sub 180. The bottom sub 190 forms a bore 195 that is in fluid communication with and forms a part of the bore 105.

The top sub 110, the spring housing 120, the upper mandrel seal sub 130, the jetting port housing 140, the lower mandrel seal sub 180 and the bottom sub 190 together make up a tubular housing for the perforating tool 100.

The perforating tool 100 additionally includes a piston assembly 150. The piston assembly 150 defines a series of components that are configured to slide together along the spring housing 120 in response to fluid pressure. The piston assembly 150 includes an orifice retainer 151, a piston body 156, a piston orifice 153 and a piston scraper retainer 157. The piston assembly 150 essentially serves as a pressure shoulder, moving down the spring housing 120 in response to fluid pressure applied from the surface.

It is observed here that while it is pressure that moves the piston assembly 150 down, it is also accurate to refer to changes in flow rate that actuate the piston assembly 150. This is because the piston orifice 153 is configured according to a desired flow rate to cause the tool 100 to change between operational modes. In this respect, the orifice 153 is sized to generate the required differential pressure across itself to function. External pressures do not have an impact on the piston assembly 150; only pressure from the flow rate through the orifice 153 changes the tool mode.

The orifice retainer 151 secures the piston assembly 150 in place below the top sub 110. Specifically, the orifice retainer 151 abuts the lower end 114 of the top sub 110 to prevent the piston assembly 150 from moving further upstream. Various o-rings (not numbered) may be disposed around the piston body 156 and the piston orifice 153 to prevent pressure communication between the area above the piston assembly 150 and below the piston assembly 150. Additional details concerning the piston assembly 150 are provided below in connection with FIGS. 8A through 8C.

As stated above, the piston assembly 150 is operatively connected to a mandrel 155. The mandrel 155 has an upper (or upstream) end 152 connected to (or acted upon by) the piston assembly 150, and a lower (or downstream) end 154. The upper end 152 of the mandrel 155 is threadedly connected to the piston body 156. The piston assembly 150 and connected mandrel 155 reside within the inner diameter of the spring housing 120. Of interest, an upper end of the spring 125 acts against the piston scraper retainer 157, biasing the piston assembly 150 against the top sub 110.

In operation, hydraulic pressure (generated by fluid flow through the piston orifice 153) acts on the shoulder that is the upper side of the piston assembly 150 above the piston orifice 153. In response, the piston assembly 150 and connected mandrel 155 move down the tubular housing 110 together. Specifically, the piston assembly 150 (and connected mandrel 155) moves from its raised position (shown in FIG. 1A), to a lowered position (shown in FIG. 2A).

It is noted that the spring 125 resides in an annular region formed between the mandrel 155 and the surrounding spring housing 120. This first annular region is pressure-balanced via ports 159 in the mandrel 155. These ports let the fluid volume inside the spring housing 120 change as the piston assembly 150 moves up and down.

A second annular area 145 is reserved between the mandrel 155 and the surrounding jetting port housing 140. A pair of annular seals 162, 164 resides within the annular area 145. The seals 162, 164 may be mechanically or adhesively affixed to inner diameters of the upper mandrel seal sub 130 and the lower mandrel seal sub 180, respectively. Thus, the seals 162, 164 do not slide along the bore 105 with the mandrel 155.

It is observed that the seals represent an upper seal 162 and a lower seal 164. The two seals 162, 164 straddle the jetting ports 148 along the jetting port housing 140.

At the lower end 154 of the mandrel 155 is a plunger 160. The plunger 160 defines a short body that is configured to sealingly land onto a seat 170 (described below). An upper end 162 of the plunger 160 is connected to the lower end 154 of the mandrel 155. In this way, the plunger 160 moves up and down along the bore 105 of the perforating tool 100 with the mandrel 155.

The mandrel 155 also includes one or more flow ports 185. The flow ports 185 preferably reside immediately above the plunger 160. The flow ports 185 provide fluid communication between the bore 105 of the tool 100 and the annular region 145 when the wellbore clean-out tool 100 is in its flow-through mode.

Finally, the perforating tool 100 comprises a seat 170. The seat 170 defines a short tubular body having a flow-through opening 175. The seat 170 is configured to sealingly receive the plunger 160 when the piston body 150 is moved to a lowered position (seen in FIG. 2A). Of interest, the opening 175 is sized to provide little to no restriction in downhole fluid flow when the plunger 160 is in the flow-through mode of FIG. 1A.

In the view of FIG. 1A, the piston body 150 is at is uppermost position. This is its default (or raised) position wherein the orifice retainer 155 is abutting the lower end 114 of the top sub 110. As noted, the piston body 150 is held in this default position due to the upward mechanical force provided by the spring 125.

A piston o-ring may be disposed around the piston body 156 to prevent pressure communication between the area above the piston body 156 and below the piston body 156 when fluid is passing through the orifice 153. Additionally, an orifice o-ring may be disposed around the orifice 153 to prevent pressure communication between the area above the orifice 153 and below the orifice 153 when fluid is passing through the orifice 153.

In the raised position of FIG. 1A, fluid is injected by an operator into the bore 105 of the perforating tool 100 under a first pressure. The first pressure correlates to a first flow rate. Those of ordinary skill in the art will understand that there is a correlation between flow rate, tubular dimension and pressure. At the first flow rate, the hydraulic pressure acting on the piston assembly 150 is not great enough to cause the piston assembly 150 to compress the spring 125.

In the position of FIG. 1A, the plunger 160 remains in its raised position above the seat. As working fluid is injected into the wellbore 1000 at the first flow rate, fluid will pass through the bore 105 of the tool 100, through the flow ports 185, into the annular region 145, around the plunger 160, and then down through the flow-through opening 175 of the seat 170.

Figure 1B:
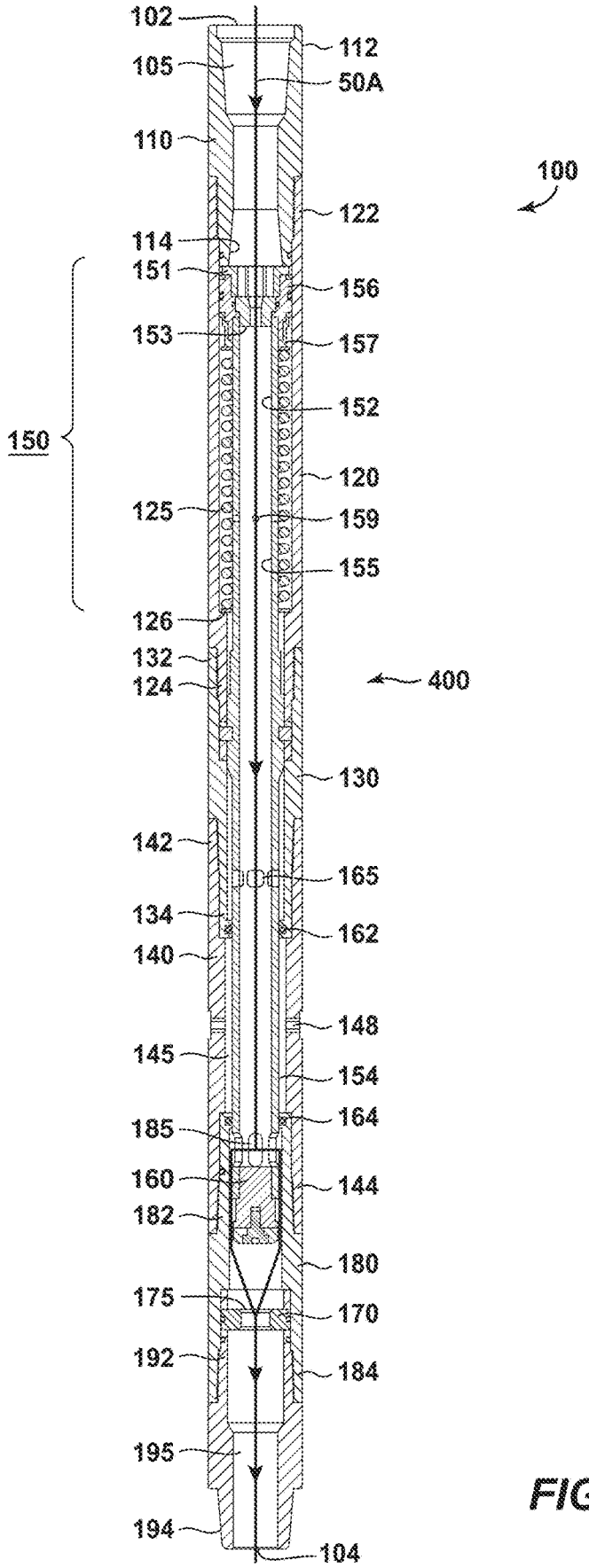
FIG. 1B is a second cross-sectional view of the perforating tool of FIG. 1A. The perforating tool is again in its raised position, or flow-through mode. Here, a flow path of injected fluid is shown.

FIG. 1B is another cross-sectional view of the perforating tool 100 of FIG. 1A. In this view, line 50A is provided to demonstrate a path of the injected fluids for the tool in its flow-through mode. Fluids are shown entering the upper end 102 of the tool 100, and then ultimately passing out of the lower end 104 according to the flow path described immediately above. Of interest, all pumped fluids pass through the flow ports 185, into the annular area 145, around the plunger 160, through the opening 175 in the seat 170, and on to any bottom hole assembly that may reside below the tool 100. Beneficially, the lower seal 164 prevents pumped fluids from flowing back up the annular area 145 to a level of lateral jetting nozzles (or jetting ports) 148 when the tool 100 is in its flow-through mode.

In operation, once the wellbore clean-out tool 100 is set at a desired depth within the wellbore 1000, the operator will begin pumping. During pumping, the operator will increase the pump rate. This will apply a greater hydraulic force to the shoulder of the piston assembly 150 and will start to overcome the biasing force of the spring 125 (plus any friction created by o-rings). The piston assembly 150, the mandrel 155 and its connected plunger 160 will then start to move down the bore 105.

The aperture size of the orifice 153 defines the activation rate. Thus, one aspect of using the abrasive perforating tool 100 involves the selection of the aperture size of the orifice 153. Alternatively or in addition, the operator may select an opening size for the flow ports 185 and the seat 170.

Figure 1C:
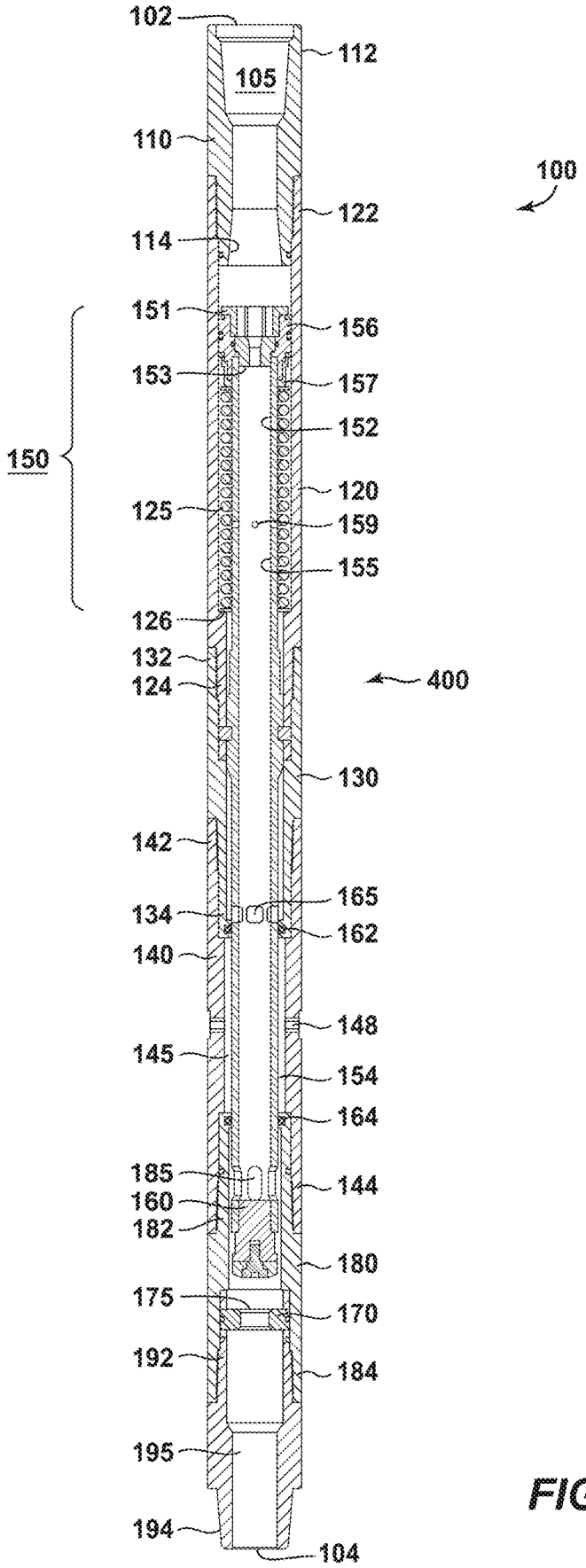
FIG. 1C is a third cross-sectional view of the perforating tool of FIG. 1A. Here, the perforating tool has been cycled to an intermediate position. In this position, the plunger has advanced partially down the tool, but all of the injected fluid continues to flow through the seat at the bottom of the tool.

FIG. 1C is still another cross-sectional view of the perforating tool 100 of FIG. 1A. Here, an increase in fluid pumping pressure from the surface is acting on the piston body 156, causing the piston body 156 and connected mandrel 155 and plunger 160 to advance down the spring housing 120. Stated another way, hydraulic pressure acting on the piston body 156 overcomes the upward biasing force of the spring 125, causing the mandrel 155 and plunger 160 to move towards the seat 170.

In FIG. 1C, the perforating tool 100 is in an intermediate position. In this position, all of the injected fluid continues to flow through the end 104 of the tool 100. In this respect, fluids continue to flow through the flow ports 185, into the annular area 145, around the plunger 160, and through the flow-through opening 175 of the seat 170. Lower seal 164 prevents the fluids from moving up the annular region 145 and accessing the jetting ports 148.

Figure 2A:
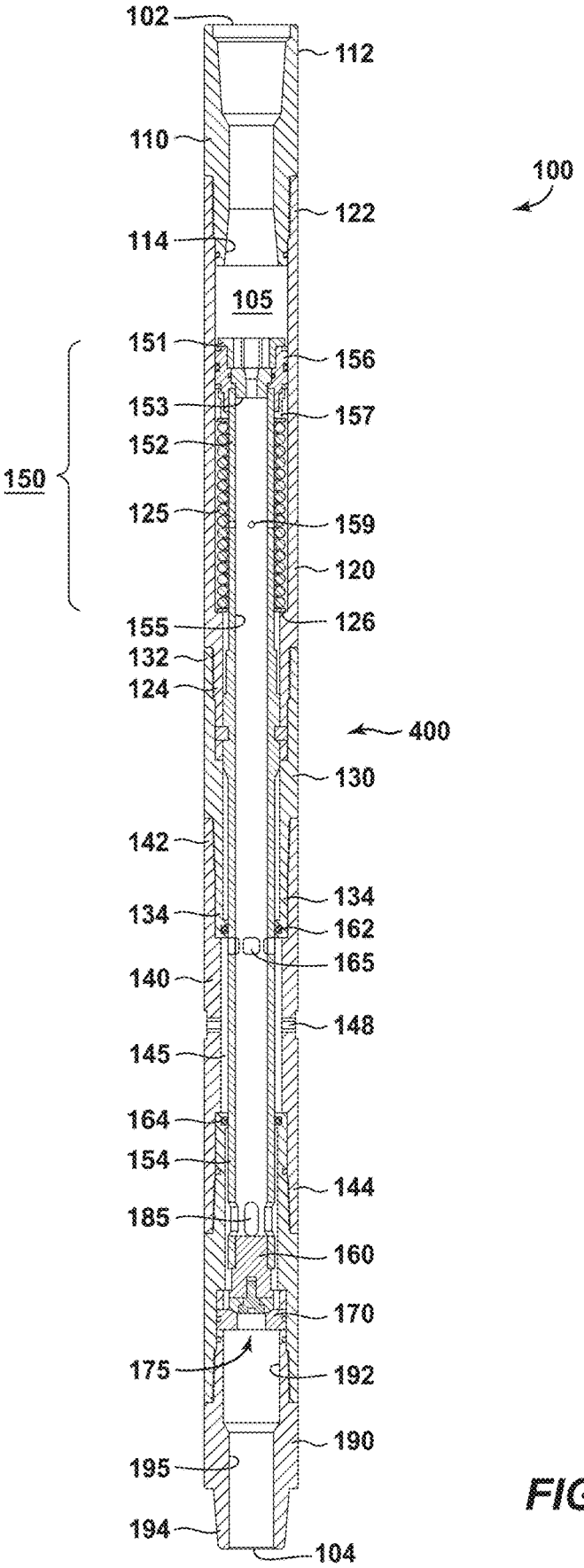
FIG. 2A is a cross-sectional view of the perforating tool of FIG. 1A. Here, the tool has advanced to its lowered position. This is an abrasive perforating mode, with all of the injected fluids being diverted from the tool through lateral jetting ports.

FIG. 2A is another cross-sectional view of the multi-cycle perforating tool 100 of FIG. 1A. Here, the perforating tool 100 has further translated (that is, has moved down the spring housing 120) to its abrasive perforating position. This is done by further increasing the hydraulic force acting on the piston assembly 150. Specifically, an increased flow rate from the surface acts on the body 156 of the piston assembly 150.

The increased hydraulic force is achieved by increasing pump rate of the hydraulic fluid into the wellbore from the surface. In response to the increased pressure (or increasing flow rate), the piston body 156 and operatively connected mandrel 155 and plunger 160 have slid down to a position where the lower end 164 of the plunger 160 lands on the seat 170.

It is observed from FIG. 2A that in addition to flow ports 185, the mandrel 155 also includes slots 165. The slots 165 reside higher up the mandrel 155, that is, above flow ports 185. The slots 165 also provide fluid communication between the bore 105 and the annular region 145. In the flow-through mode of FIGS. 1A and 1C circulation fluids that flow through the slots 165 are blocked from leaving the tool 100 by the upper seal 162. However, in the perforating mode of FIG. 2A, as the mandrel 155 has moved down, the slots 165 have moved into a position adjacent the jetting ports 148. Thus, abrasive perforating fluids are injected through the slots 165 and through the jetting ports 148.

Figure 2B:
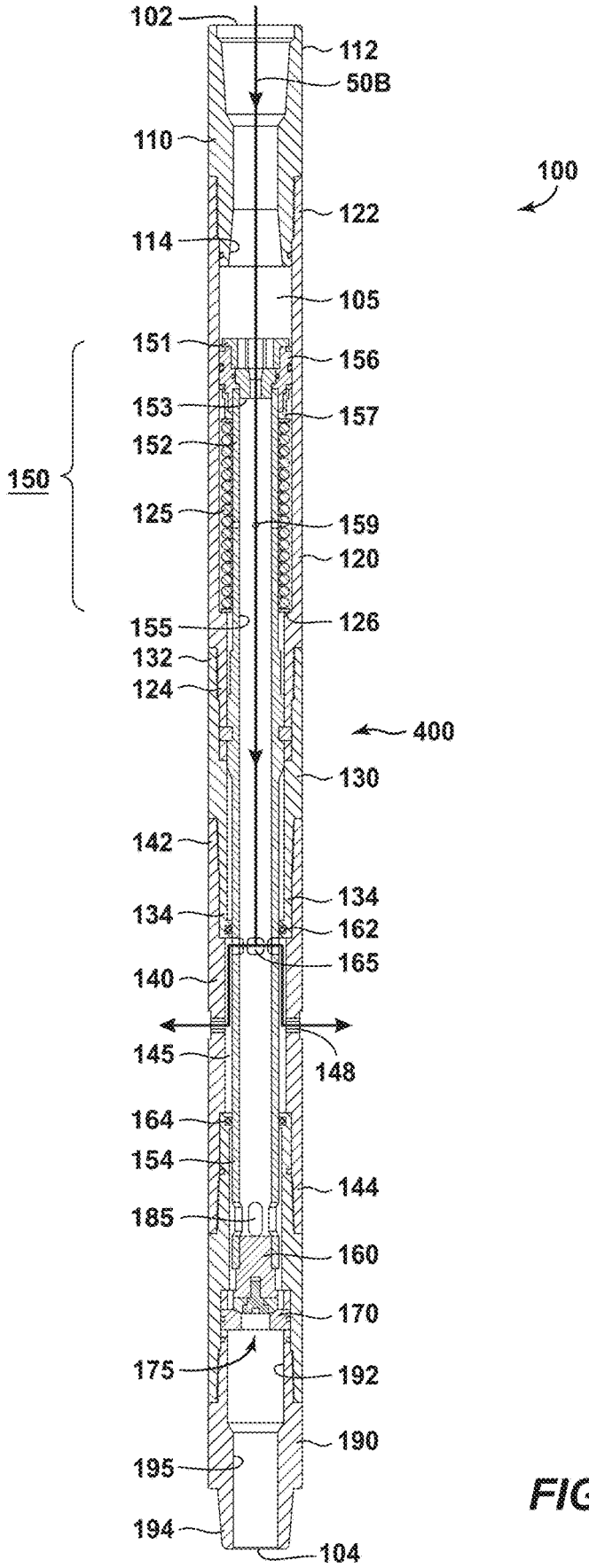
FIG. 2B is a second cross-sectional view of the perforating tool of FIG. 2A. The perforating tool again is in its lowered position, or abrasive perforating mode. Here, a flow path of injected perforating fluid is shown.

FIG. 2B is another cross-sectional view of the multi-cycle abrasive perforating tool 100 of FIG. 2A. The perforating tool 100 again is in its lowered position, or abrasive perforating mode. In this view, line 50B is provided to demonstrate a flow path of the perforating fluids for the tool 100. Fluids are shown entering the upper end 102 of the tool 100, and then exiting out of the jetting ports 148. Of interest, all fluids exit the tool 100 through the slots 165, and are confined to exit through the jetting ports 148 by the upper 162 and lower 164 seals.

It is also observed that in the perforating position of FIGS. 2A and 2B, fluid communication remains between the bore 105 and the annular region 145 through the flow ports 185. However, any fluids that exit the flow ports 185 or that reside in the annular region 145 below the lower seal 164 are trapped. Fluids can exit neither the flow-through opening 175 of the seat 170 nor the jetting ports 148. Thus, complete fluid isolation is provided in both the flow-through mode and the perforation mode, meaning there is no "split flow."

As described above, the cycling of the tool 100 between its raised position (FIG. 1A) and its lowered position (FIG. 2A) may be accomplished by applying pumping pressure against the biasing force of the spring 125. However, in a more preferred embodiment a mechanical sequencing mechanism is also used. The sequencing mechanism is preferably a J-slot mechanism as shown at 400 in FIGS. 4A-4D, discussed below. The sequencing mechanism 400 allows the operator to cycle the flow rates to move the tool 100 between settings so that:

(i) In a first setting, the plunger 160 is in a raised position in response to the biasing mechanical force exerted by the spring 125 on the mandrel 155, placing the tool in its flow-through mode. This is the view of FIG. 1A.

(ii) In a second setting, the pumping rate is increased and the J-slot mechanism 400 advances to a next slot, allowing the plunger 160 to move down to an intermediate position. In the intermediate position, the tool 100 remains in its flow-through mode, allowing the operator to inject hydraulic fluid into the bore 105 of the tubular housing 110 and through the seat 170 at a second rate, or at any rate higher than the second rate. This is the view of FIG. 1C.

(iii) In the first setting again, hydraulic pumping rate is reduced to its first rate, or any rate below the first rate, allowing the plunger 160 to return to its raised position. The perforating tool 100 remains in its flow-through mode.

(iv) Finally, in a third setting, the plunger 160 is forced down into a lowered position in response to the injection of hydraulic fluid through the piston assembly 150 and into the perforating tool 100 at a second rate, or at any rate higher than the second rate. The J-slot mechanism 400 advances to a next slot, placing the perforating tool 100 in its abrasive perforating mode. This is the view of FIG. 2A.

Beneficially, in the second setting the operator may ramp up the pumping pressure and be assured that all fluids are passing through the seat. This allows the operator to place a bottom hole assembly at the end of the bottom sub, conducting an additional wellbore function.

An example of such a function is the milling out of a plug or drilling through the bore of a section of horizontal casing that is screened out or contains debris. In this respect, the bottom end 194 of the sub 190 is configured to threadedly connect to a separate tool that may be placed in the wellbore 1000 below the perforating tool 100. For example, a positive displacement motor may be placed downstream from the perforating tool 100.

Figure 3A:
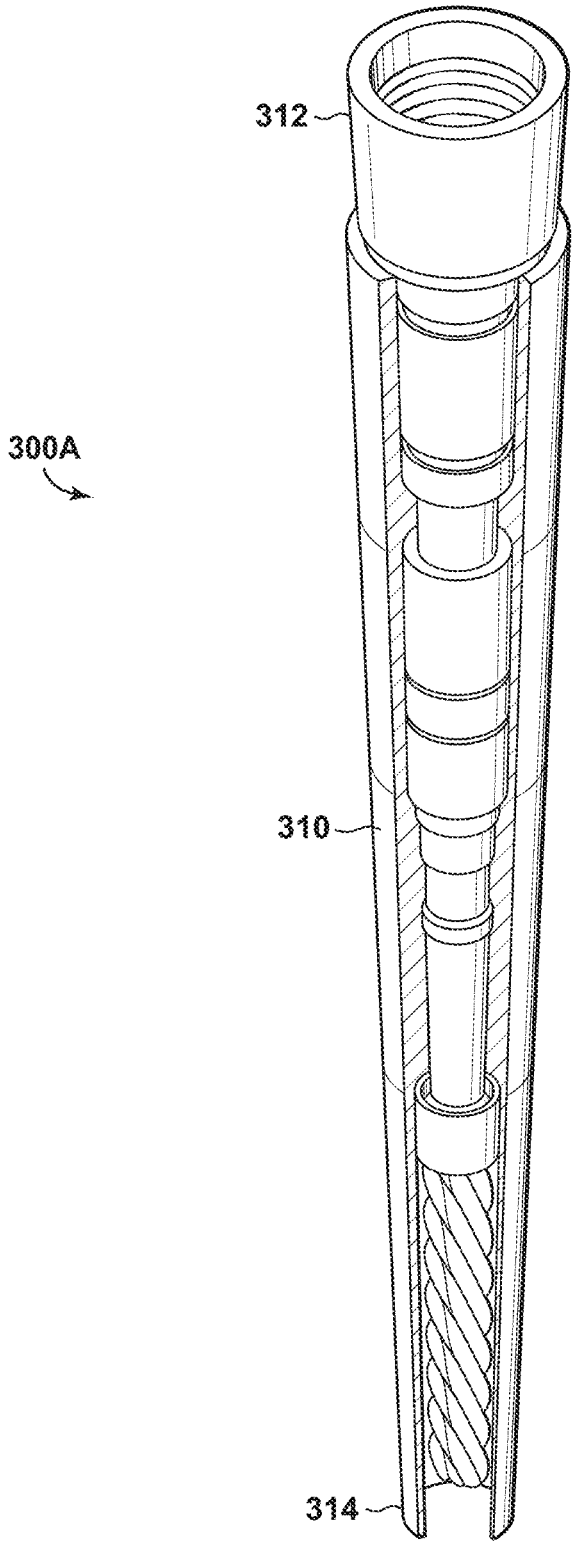
FIG. 3A is a perspective view of a positive displacement motor as may be placed below the perforating tool of FIGS. 1A and 2A.

FIG. 3A is a perspective view of a positive displacement motor 300A. This provides an example of a rotary tool that may be connected to the bottom sub 190. It can be seen that the motor 300A includes an elongated tubular body 310. The body 310 defines a fluid in-take end 312 and a fluid outlet end 314. The positive displacement motor 300A operates with a rotor and a stator residing within the tubular body 310. In one aspect, the positive displacement motor 300A is used as an agitator, sending pressure pulses across the wellbore downhole while cleaning. In another aspect, a small drill bit (not shown) is connected to the outlet end 314, and is turned by the rotor of the motor 300A. The drill bit may be used to mill through plugs or debris.

It is understood that the positive displacement motor 300A is merely illustrative; other positive pressure tools may be placed downstream of the seat 170.

Figure 3B:
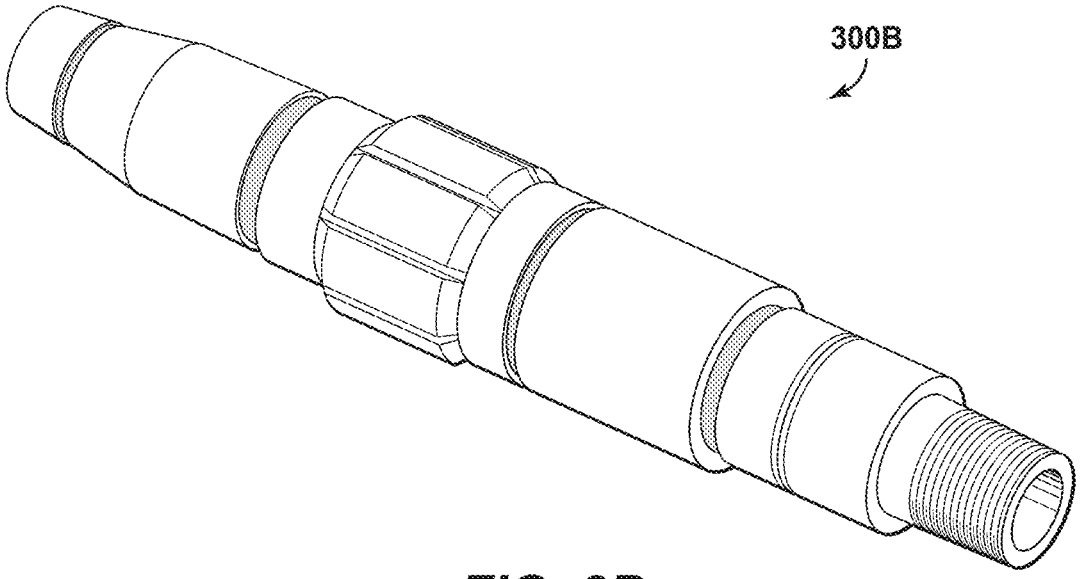
FIG. 3B is an example of a suitable sliding sleeve shifting tool that may be used as part of a bottom hole assembly with the perforating tool of FIGS. 1A and 2A.
Figure 3C:
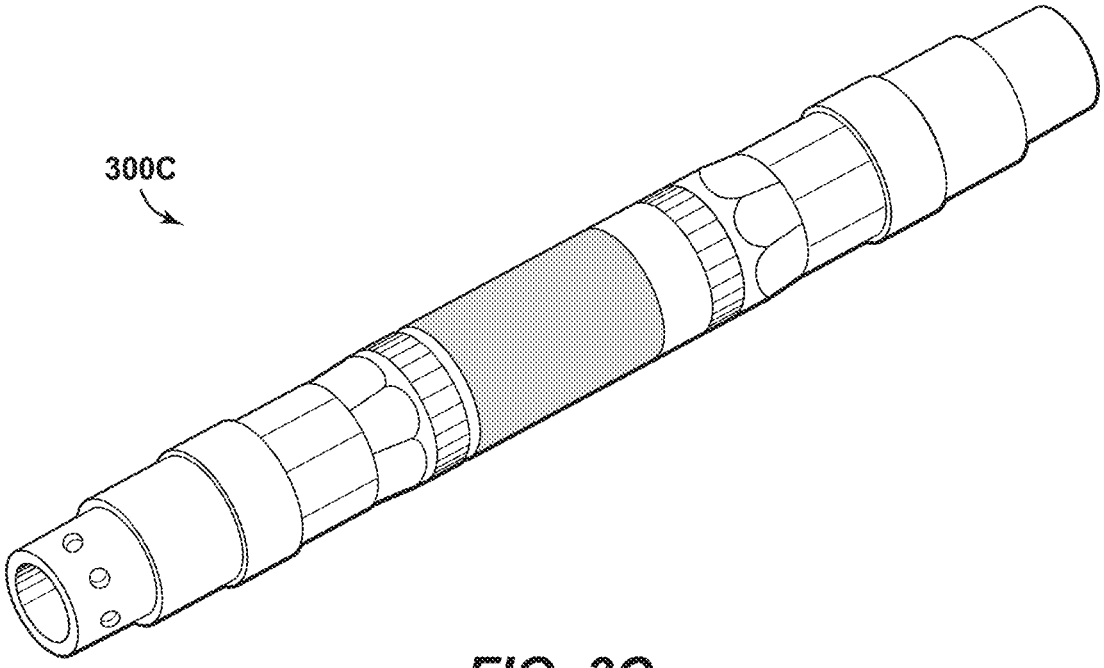
FIG. 3C is an example of a bridge plug that may be set, retrieved or drilled out using a bottom hole assembly that includes the perforating tool of FIGS. 1A and 2A.
Figure 3D:
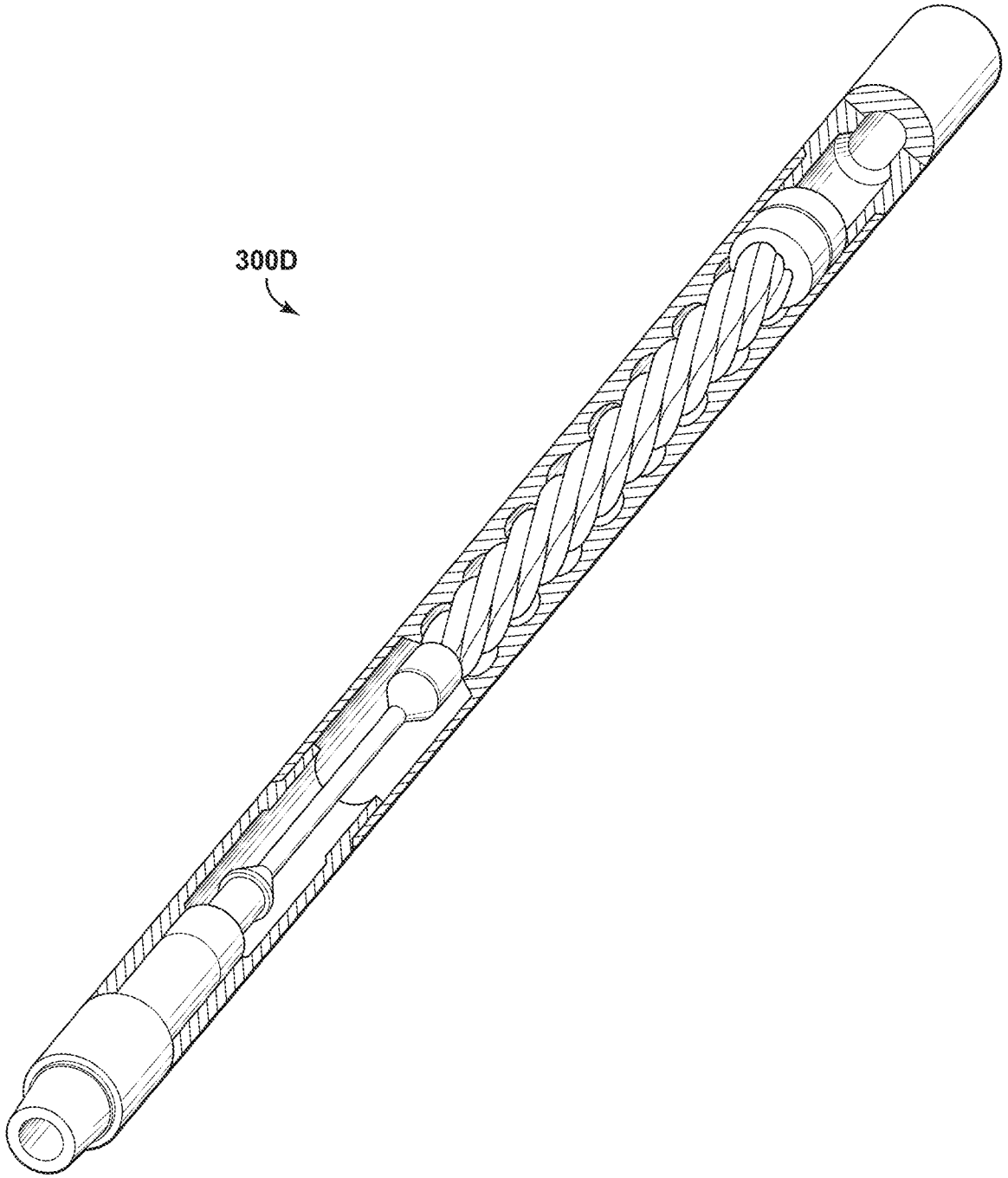
FIG. 3D is an example of an extended reach tool that may be used as part of a bottom hole assembly with the perforating tool of FIGS. 1A and 2A.
Figure 3E:
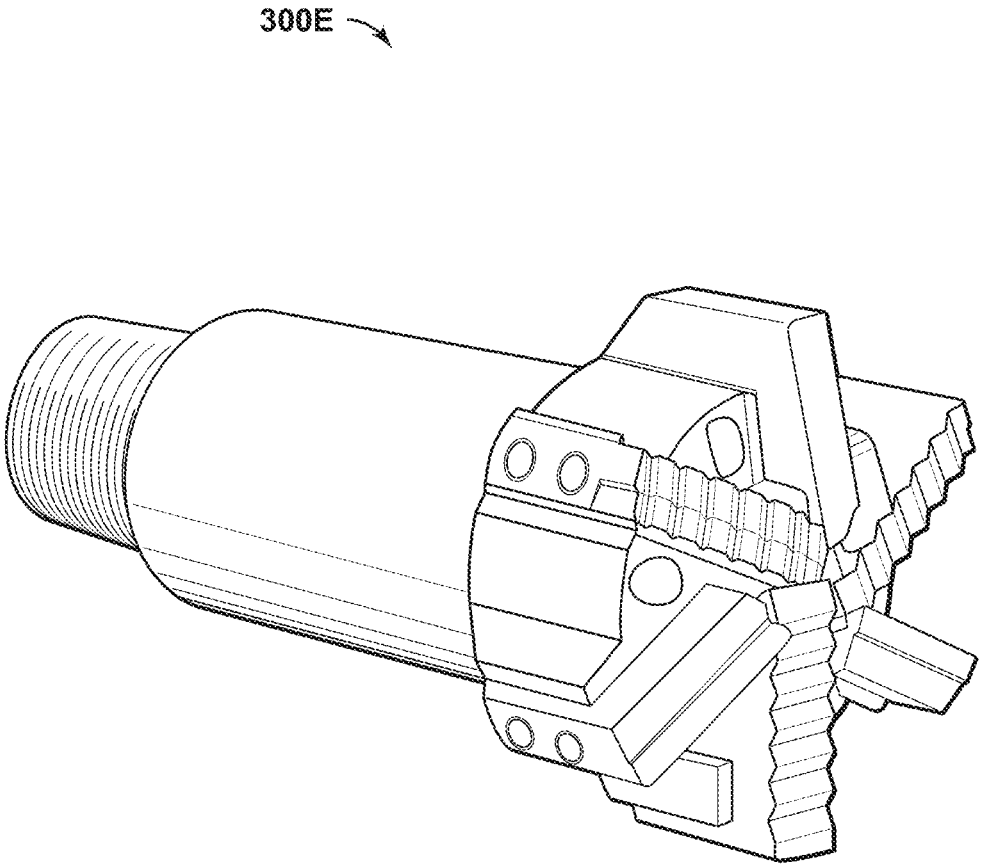
FIG. 3E is a perspective view of a milling tool as may be used at the bottom of the perforating tool of FIGS. 1A and 2A.

FIG. 3E is an example of a mill bit 300E that that may be used to mill out a bridge plug or debris within the wellbore.

As noted, to enable the cycling, a sequencing mechanism such as a J-slot mechanism may be provided. A J-slot mechanism is a cylindrical device having a circuitous channel forming slots. One or more pins ride along the slots, rotating from slot-to-slot in response to changes in fluid pressure.

Figure 4A:
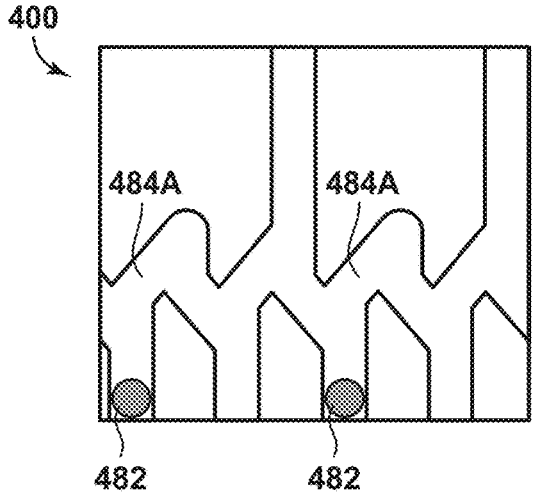
FIG. 4A is a side view of a j-slot mechanism. In this view, pins are in a default position along the slots.

FIG. 4A is a side view of a portion of a J-slot mechanism 400. It can be seen that a pair of pins 482 reside in respective lower slots 484A. This is a slot position that would correlate with the default, or raised position of the plunger 160 as presented in FIGS. 1A and 1B. In this position, the pump rate is below the activation rate. This cycle position will allow injected fluid to flow to the flow ports 185, sending the fluid on through the bottom end 194 of the bottom sub 190.

Figure 4B:
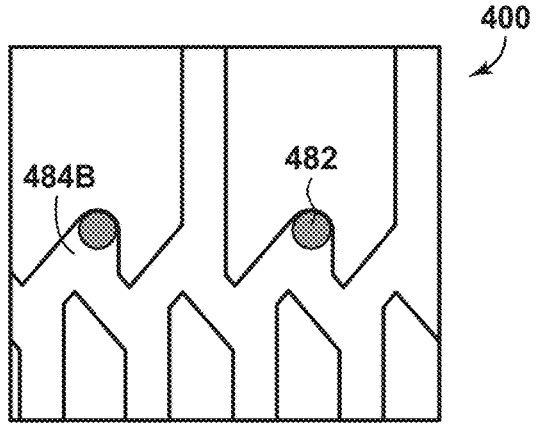
FIG. 4B is another side view of the j-slot mechanism of FIG. 4A. In this view, the pins have advanced along the channel and are in an intermediate position. To achieve this, a mandrel has been pushed down along a spring housing.

FIG. 4B is another side view of the J-slot mechanism 400 of FIG. 4A. In this view, the pins 482 have advanced one slot 484B. In slot 484B, the pins 482 are in an intermediate position. This is a slot position that would correlate to the operator increasing pump rate from the surface as shown in FIG. 1C. In this position, the location of the J-slot pins 482 restricts the movement of the plunger 160 while allowing the flow-rate to beneficially move above the activation rate. In other words, the plunger 160 will not advance along the mandrel 155 even when the pump rate is well above the activation rate, allowing operation of the positive displacement motor 300A.

Figure 4C:
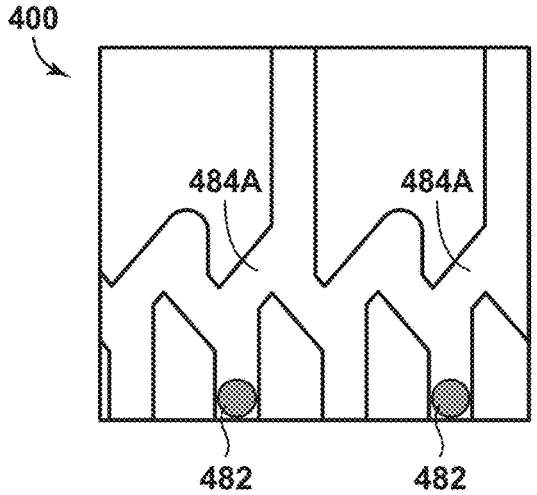
FIG. 4C is another side view of the j-slot mechanism of FIG. 4A. In this view, the pins have advanced along the channel to a second slot, allowing the mandrel to return to its default position of FIG. 4A.

FIG. 4C is another side view of the J-slot mechanism 400 of FIG. 4A. In this view, the pumping rate has been dropped back below the activation rate, causing the pins 482 to follow along the channel and to advanced one slot 484A. In this position 484A, the plunger 160 has returned to its raised position per FIG. 1A.

Figure 4D:
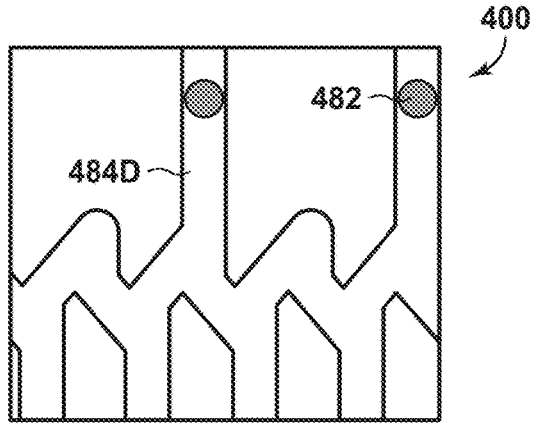
FIG. 4D is still another side view of the j-slot mechanism of FIG. 4A. In this view, the pins have advanced to a new slot along the channel, allowing the mandrel to move into its fully lowered position. In this position, the plunger lands on the seat per FIG. 2A.

FIG. 4D is still another side view of the J-slot mechanism 400 of FIG. 4A. In this view, the pump rate has again been increased above the activation rate, causing the pins 482 to advance along the channel to a next slot 484D. In this position, the plunger 160 is seated, exposing the slots 165 to the jetting ports 148 per FIG. 2A. In this position, the operator may inject at high rates to perforate a surrounding section of production casing.

In operation, the pins 482 advance from slot-to-slot in response to alternating cycles of the piston body 150 and connected internals moving longitudinally. The pins 482 cause the piston assembly 150 and connected internals to ratchet, or rotate, in a circular path. Also, the component housing the J-slot pin or pins 482 may ratchet, or rotate, in a circular path. The J-slot grooves (484A) are configured so that the piston body 150 and connected internals travel is unrestricted in the upward direction so that every time the flow rate is brought below the activation rate the plunger 160 is in its raised position and cannot seal against the seat 170. Additionally, on alternating cycles of the flow rate being brought to or above the activation rate, the J-slot grooves allow the piston body 150 and connected internals to move down so the plunger 160 seals against the seat 170.

Figure 5A:
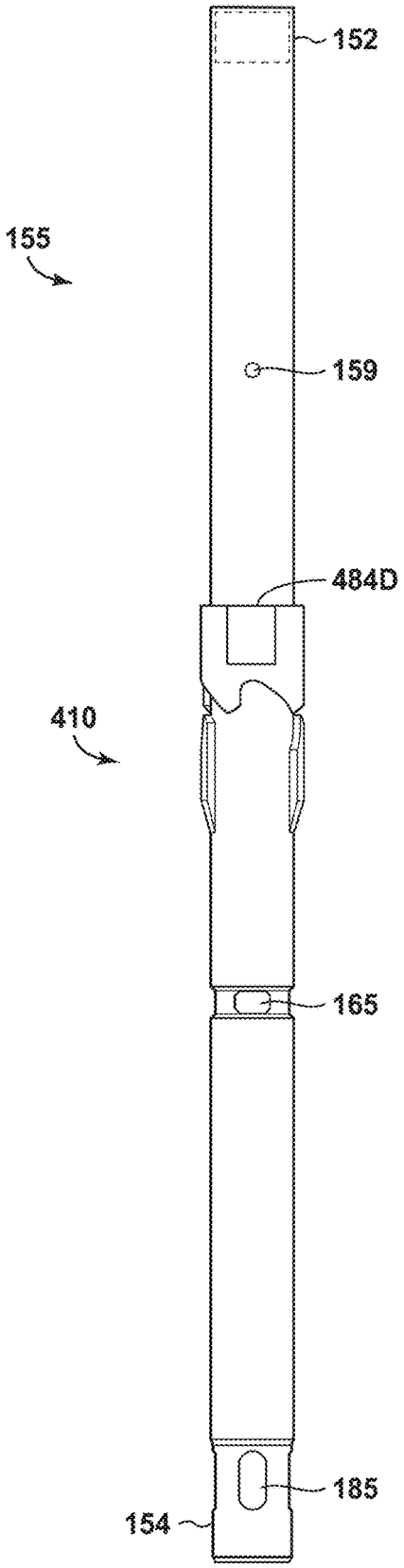
FIG. 5A is side view of the mandrel of FIGS. 1A and 2A. So called J-slots are visible along the outer diameter of the mandrel. These are part of a sequencing mechanism.

FIG. 5A is side view of the mandrel 155 of FIGS. 1A and 2A. So called J-slots 410 are visible along the outer diameter of the mandrel 155. Also of interest, flow ports 185 can be seen below the J-slots 410 while radial slots 165 can also be seen below the J-slots 410.

Figure 5B:
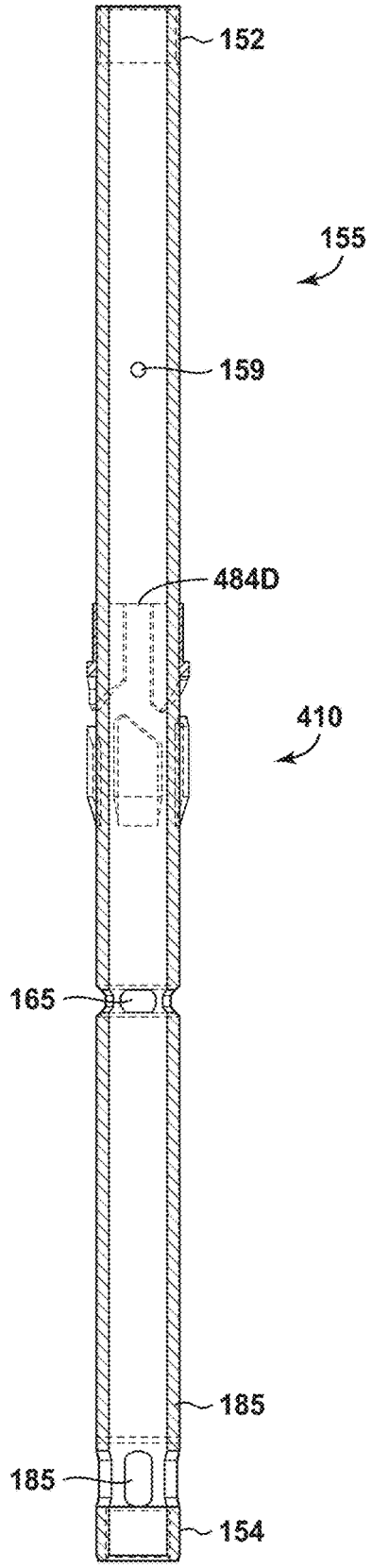
FIG. 5B is a cross-sectional view of the mandrel of FIG. 5A. The view of the J-slots is retained in phantom.

FIG. 5B is a cross-sectional view of the mandrel 155 of FIG. 5A. In both FIGS. 5A and 5B, slot 484D of the J-slots 410 is visible. Here, the J-slots 410 themselves are shown in phantom.

It is understood that the J-slots 410 of FIGS. 5A and 5B are part of the sequencing mechanism 400. The J-slots 410 work in tandem with a J-slot collar (shown at 420 in FIG. 6A).

Figure 6A:
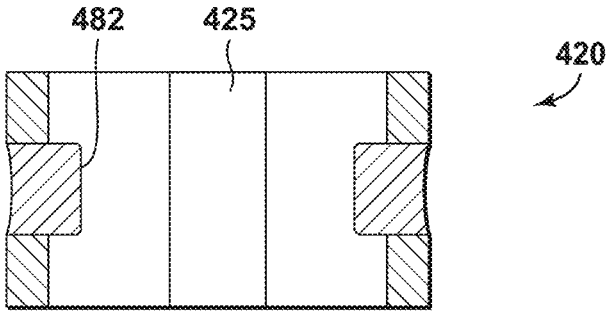
FIG. 6A is cross-sectional view of a J-slot collar, in one embodiment. The J-slot collar includes a pair of opposing pins that ride in the J-slots of FIG. 5A. The J-slot collar is also part of the sequencing mechanism.

FIG. 6A is cross-sectional view of the J-slot collar 420. The J-slot collar 420 includes a pair of opposing pins 482 that ride in the J-slots 410 of FIG. 5A.

Figure 6B:
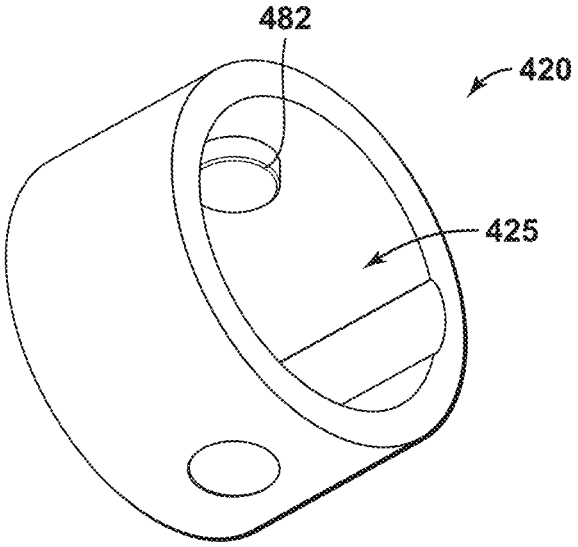
FIG. 6B is a perspective view of the J-slot collar of FIG. 6A.

FIG. 6B is a perspective view of the J-slot collar 420 of FIG. 6A. Visible in this view is one of the pins 482 extending inwardly into a bore 425.

Figure 7:
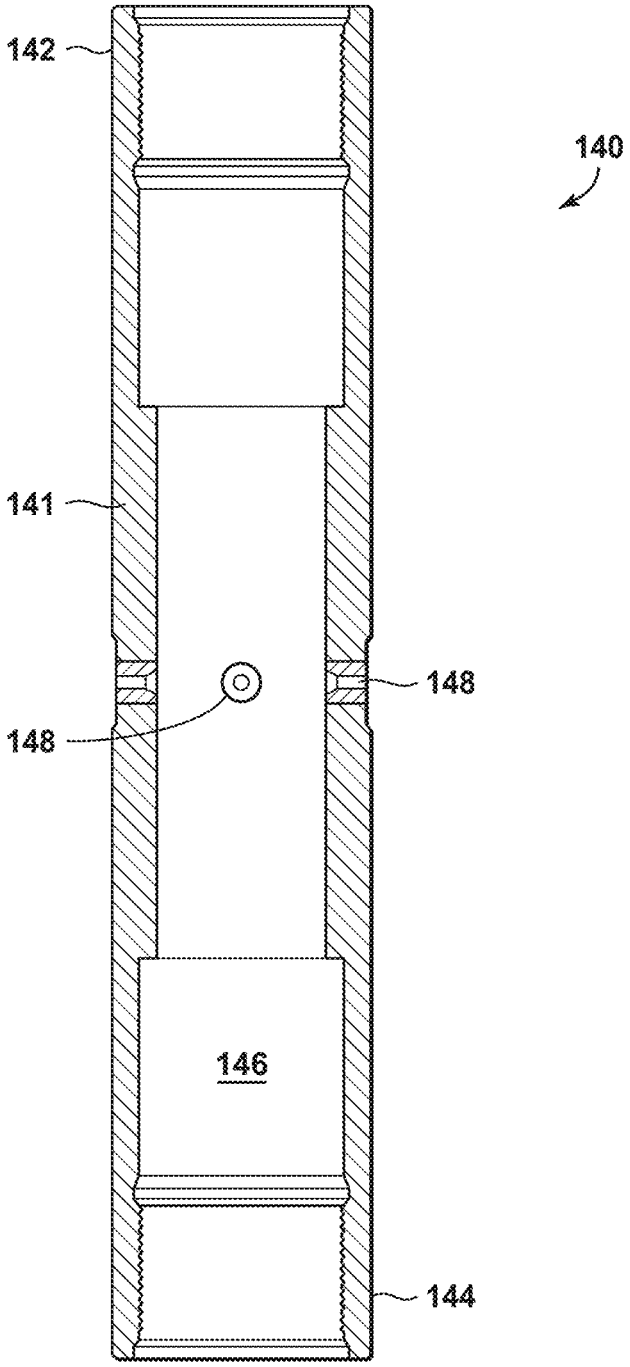
FIG. 7 is a cross-sectional view of the jetting port housing of FIGS. 1A and 2A. Jetting ports are visible in the body of the housing.

FIG. 7 is a cross-sectional view of the jetting port housing 140 of FIGS. 1A and 2A. The proximal (or upstream) end 142 and the distal (or downstream) end 144 are indicated. It is observed that the jetting port housing 140 defines a wall 141 forming a bore 146. The bore 146 extends from the proximal 142 to the distal 144 end. The jetting ports 148 are visible in the wall 141 making up the housing 140.

Figure 8A:
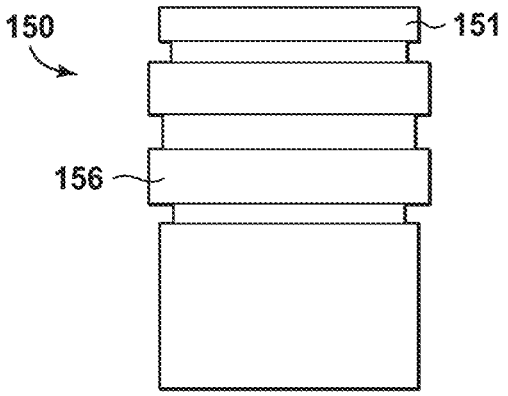
FIG. 8A is a side view of the piston assembly of FIGS. 1A and 2A.

FIG. 8A is a side view of the piston assembly 150 of FIGS. 1A and 2A.

Figure 8B:
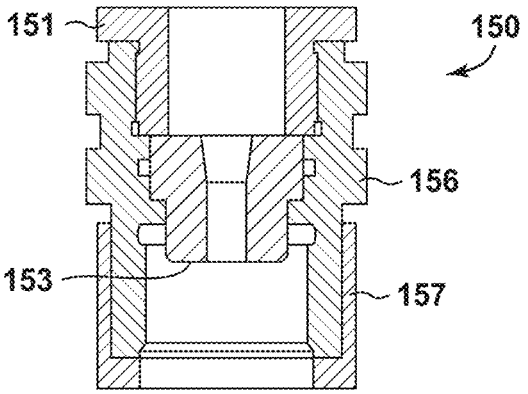
FIG. 8B is a cross-sectional view of the piston assembly of FIG. 8A.

FIG. 8B is a cross-sectional view of the piston assembly 150 of FIG. 8A.

Figure 8C:
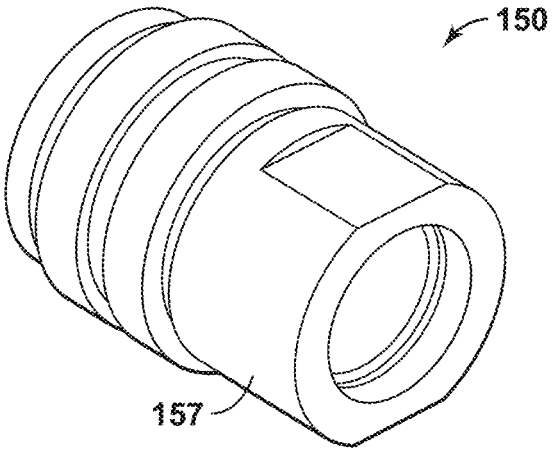
FIG. 8C is a perspective view of the piston assembly of FIG. 8A.

FIG. 8C is a perspective view of the piston assembly 150 of FIG. 8A. The piston assembly 150 will be discussed with reference to FIGS. 8A-8C together.

The piston assembly 150 includes an orifice retainer 151, a piston body 156, a piston orifice 153 and a piston scraper retainer 157. The piston orifice 153 resides below the orifice retainer 151. The piston orifice 153 comprises a shoulder, with the shoulder being exposed to fluid pressure above the fluid assembly 150. The piston orifice 153 includes a central through-opening that permits working fluids to flow through the piston assembly 150 during clean-out operations. Piston scrapers (not shown) may be disposed around the piston body 156 to ensure debris is not able to reach the piston body o-ring.

Figure 9A:
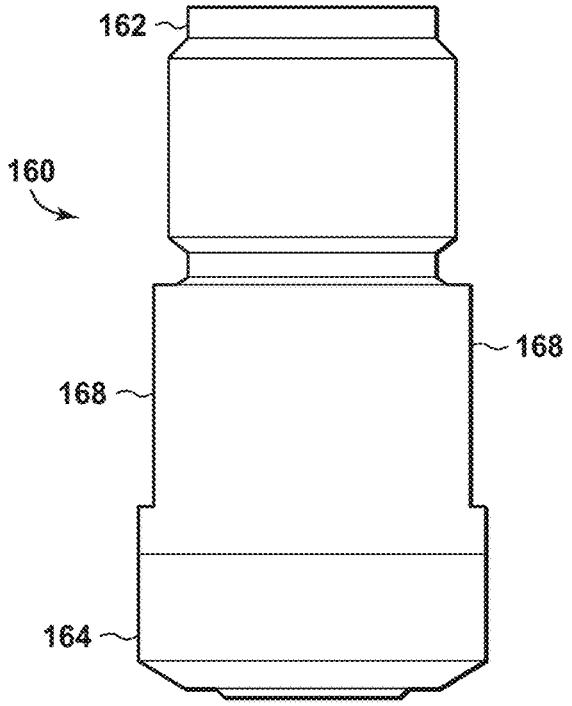
FIG. 9A is a side view of the plunger of FIGS. 1A and 2A.
Figure 9B:
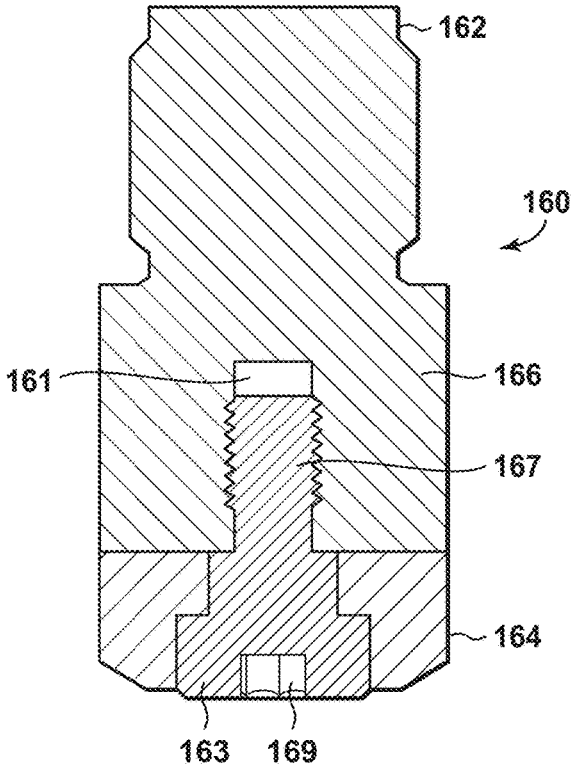
FIG. 9B is a cross-sectional view of the plunger of FIG. 9A.
Figure 9C:
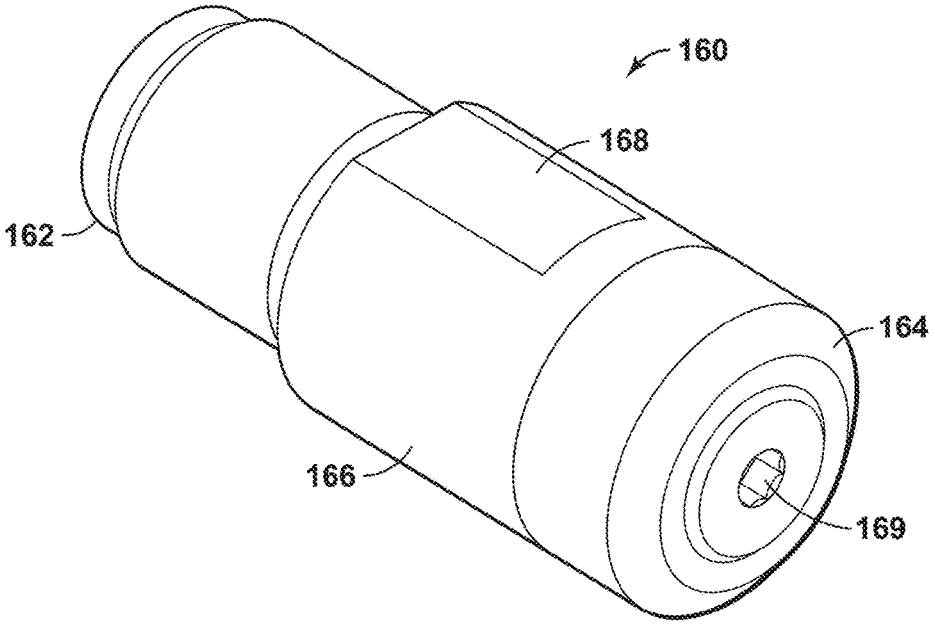
FIG. 9C is a perspective view of the plunger of FIG. 9A.

FIG. 9A is a side view of the plunger 160 of FIGS. 1A and 2A. FIG. 9B is a cross-sectional view of the plunger 160. FIG. 9C is a perspective view of the plunger 160 of FIG. 9A. The plunger 160 will be discussed with reference to FIGS. 9A, 9B and 9C together.

The plunger 160 comprises an upper end 162 and a lower end 164. The upper end 162 is mechanically or adhesively connected to a lower end of the mandrel 155. The lower end 164, in turn, is dimensioned to sealingly land onto the seat 170, above the flow-through opening 175. The plunger 160 defines a short body 166. The body 166 may comprise a solid steel, plastic or elastomeric material. Preferably, an upper portion (representing the upper end 162) of the body 166 is fabricated from plastic or steel while a lower portion (representing the lower end 164) represents a separate elastomeric body. A flat portion 168 is provided on each of opposing sides of the body 166 to facilitate threadedly connecting the plunger 160 to the mandrel 155.

An opening 161 is preserved internal to the body 166. The opening 161 is dimensioned to threadedly receive a bolt 163. More specifically, the opening 161 receives a threaded stud 167 of the bolt 163. An opening 169 for an Alan wrench is provided in the bolt 163 for securing the stud 167 into the opening 161.

When the piston assembly 150 and connected plunger 160 are in their lowered position (or abrasive perforating mode), the bottom 164 of the plunger 160 lands on the seat 170. At the same time, the slots 165 in the mandrel 155 advance to a position intermediate the upper 162 and lower 164 seals, exposing the slots 165 to the jetting ports 148. In this position, all of the jetting fluids flow down through the bore 105 of the tool 100, through the slots 165, into the annular region 145 and through the lateral jetting ports 148.

Figure 10:
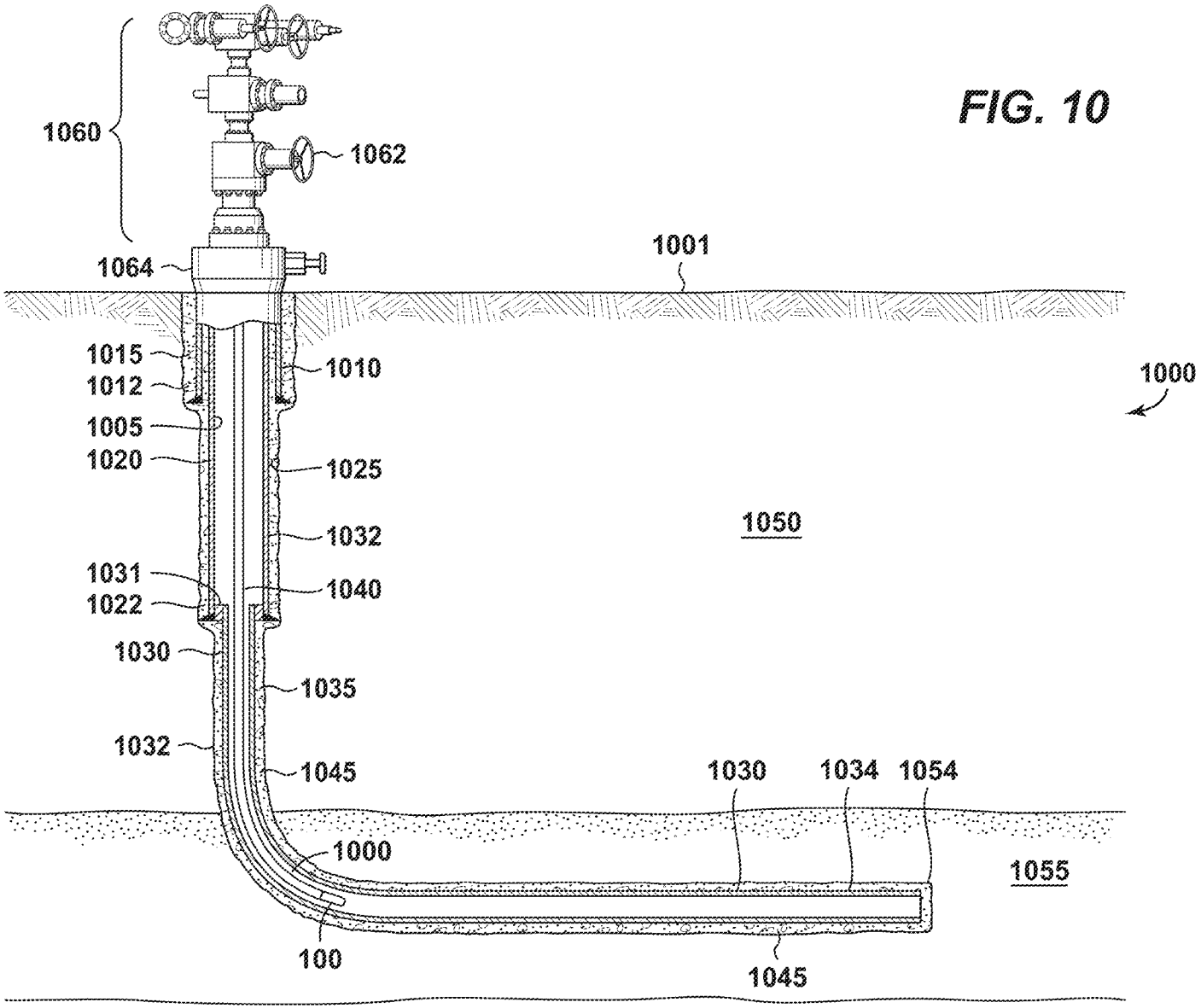
FIG. 10 is a cross-sectional view of an illustrative wellbore. Here, the wellbore has received the perforating tool of FIGS. 1A and 2A.

As noted above, the perforating tool 100 (with or without rotary tool 300A or some bottom hole assembly below) is intended to be run into a wellbore. FIG. 10 is a cross-sectional view of an illustrative wellbore 1000. The wellbore 1000 penetrates into a subsurface formation 1050 and is completed for producing hydrocarbon fluids. Of interest, for purposes of the present disclosure, the wellbore 1000 has received a multi-cycle clean-out tool such as the tool 100 of FIG. 1A.

It can be seen that the wellbore 1000 has been completed with a series of pipe strings referred to as casing. First, a string of surface casing 1010 has been cemented into the formation 1050. The cement resides in an annular region 1015 around the casing 1010, forming an annular sheath 1012. The surface casing 1010 has an upper end in sealed connection with a bottom wellhead valve 1064.

Next, at least one intermediate string of casing 1020 is cemented into the wellbore 1000. The intermediate string of casing 1020 is in sealed fluid communication with a top wellhead valve 1062. A cement sheath 1022 resides in an annular region 1025 of the wellbore 1000. The combination of the casing 1010/1020 and the cement sheaths 1010, 1022 in the annular regions 1015, 1025 strengthens the wellbore 1000 and facilitates the isolation of aquitards and formations behind the casing 1010/1020. It is understood that a wellbore 1000 may, and typically will, include more than one string of intermediate casing.

Finally, a production string 1030 is provided. The production string 1030 is hung from the intermediate casing string 1020 using a liner hanger 1031. The production string 1030 is a liner that is not tied back to the surface 1001. In the arrangement of FIG. 10, a cement sheath 1032 is provided around the liner 1030. The cement sheath 1032 fills an annular region 1035 between the liner 1030 and the surrounding rock matrix in the subsurface formation 1050.

The production liner 1030 has a lower end 1034 that extends to an end 1054 (or "toe") of the wellbore 1000. For this reason, the wellbore 1000 is said to be completed as a cased-hole well. Those of ordinary skill in the art will understand that for production purposes, the liner 1030 will be perforated after cementing to create fluid communication between a bore 1045 of the liner 1030 and the surrounding rock matrix making up the subsurface formation 1050. In one aspect, the production string 1030 is not a liner but is a casing string that extends back up to the surface 1001. In this instance, the cement sheath 1032 will not be extended to the surface 1001.

As an alternative, end 1054 of the wellbore 1000 may include joints of sand screen (not shown). The use of sand screens with gravel packs allows for greater fluid communication between the bore 1045 of the liner 1030 and the surrounding rock matrix 1050 while still providing support for the wellbore 1000. In this instance, the wellbore 1000 would include a slotted base pipe as part of the sand screen joints. Of course, the sand screen joints would not be cemented into place.

It is also noted that the bottom end 1054 of the wellbore 1000 is completed substantially horizontally. This is a common orientation for wells that are completed in so-called "tight" or "unconventional" formations. Indeed, in the United States well over half of all wells are now completed horizontally.

Horizontal completions not only dramatically increase exposure of the wellbore to the producing rock face, but also enable the operator to create fractures that are substantially transverse to the direction of the wellbore. Those of ordinary skill in the art may understand that a rock matrix will generally "part" in a direction that is perpendicular to the direction of least principal stress. For deeper wells, that direction is typically substantially vertical. However, the present inventions have equal utility in vertically completed wells or in multi-lateral deviated wells.

When completed, the wellbore 1000 will include a string of production tubing (not shown). However, before that is done, it is desirable to clean out the wellbore 1000. Accordingly, the wellbore 1000 includes a perforating tool 100 as shown in FIG. 1A.

It is noted that the perforating tool 100 is connected to a string of coiled tubing 1040. The coiled tubing string 1040 serves as a working string for delivering an aqueous fluid under high pressures downhole. Such pressures may exceed 500 psi, or even 3,000 psi. The perforating tool 200 is preferably extended along the horizontal leg of the wellbore within the subsurface formation 1055.

A lubricator 1060 or frac tree is placed over the wellbore 1000. The lubricator 1060 is positioned at the surface 1001 to control wellbore pressures during a completion (or other wellbore) operation and to isolate tools such as a string of coiled tubing 1040 being moved into and back out of the wellbore 1000.

As can be seen, a unique abrasive perforating tool 100 has been provided. The perforating tool acts as a flow diverter that increases the efficiency of fill removal operations. Fluid flow can be entirely in a straight-through path of the tool to an optional bottom hole assembly below. In addition, the fluid flow can also be entirely diverted to jetting ports. The cycling of fluid flow modes is possible an unlimited number of times and does not require dropping a ball or reversing circulation.

Figure 11:
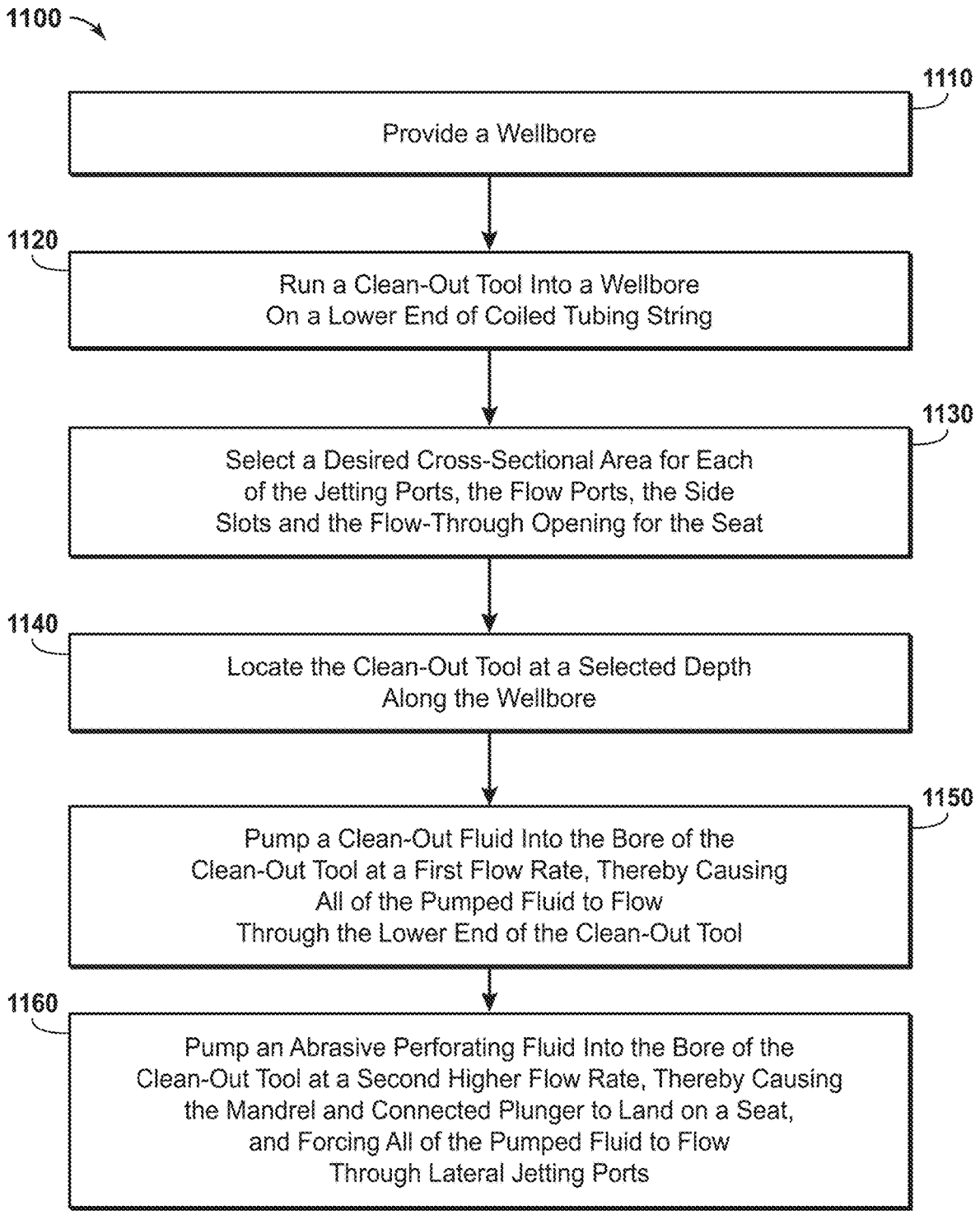
FIG. 11 is a flow chart showing operational steps for controlling a flow of fluid through the perforating tool, in one arrangement.

Using the perforating tool 100 described above, a method 1100 of conducting a wellbore operation is also provided. The method 1100 is presented in the flow chart of FIG. 11.

The method 1100 first includes providing a wellbore. This is indicated at Box 1110. The wellbore is being completed for the production of hydrocarbon fluids. Of interest, the wellbore has been completed with a string of casing, including a string of production casing along a selected subsurface formation.

The wellbore may be completed vertically. Alternatively, the wellbore may be a deviated well formed from a lateral drilling operation. More preferably, the wellbore is completed horizontally as shown in FIG. 10. However, the methods are not limited to the orientation of the wellbore unless expressly stated in the claims.

It is understood that for purposes of Box 1110, the term "providing" includes but is not limited to "forming" or "completing." The term "providing" may also mean that a service company accesses a wellbore that has already been drilled and completed, or accesses a wellbore that has been undergoing production operations for a period of time.

The method 1100 also includes running a perforating tool into the wellbore. This is provided in Box 1120. The perforating tool is run into the wellbore at the lower end of a string of coiled tubing 1040. The perforating tool may be constructed in accordance with any of the embodiments described above. Particularly, the perforating tool is a multi-cycle tool having a tubular housing that includes an elongated bore. Fluids are pumped from the surface, down the string of coiled tubing, and into the bore.

The perforating tool includes one or more lateral jetting ports. The jetting ports are spaced apart radially around the housing, and preferably constitute two levels of ports in close proximity to one another. The jetting ports deliver an abrasive fluid to the casing when the tool is in its perforating mode.

The method 1100 may additionally include tuning the various openings along the tool in order to provide a desired total cross-sectional area of fluid flow in the perforating tool. This is seen at Box 1130. For example, the step of Box 1130 may include setting or adjusting an aperture size of an orifice associated with the piston. This has the effect of varying flow rates associated with the raised and lowered positions.

In order for the perforating tool to change modes, the piston orifice needs to be sized small enough to ensure the required activation rate will be achievable during the operation. Although the perforating tool will change modes correctly, sizing the piston orifice too small for a planned pump-rate will cause excessive and unnecessary pressure drop that may limit the total flow capacity of the operation in flow-through mode. Optimally, the piston orifice is sized appropriately to ensure the activation rate will be achievable in both modes throughout the operation with minimal back-pressure.

Additionally, the Box 1130 may include a step of selecting or adjusting the cross-sectional area of the flow ports along the mandrel, and/or a step of selecting or adjusting a diameter of the lateral slots associated with the mandrel and the flow-through opening associated with the seat. A larger cross-sectional area in the opening of the seat enables more working fluid to flow from the perforating tool en route to the PDM 300A.

Additionally, the Box 1130 may also include a step of adjusting a size of the lateral jetting ports. The ports should be small enough to provide ample flow restriction for effective jetting.

It is observed that while Box 1130 is shown after the step of running the perforating tool into the wellbore, it is understood that these adjustments of Box 1160 will be taken during tool design and before the tool is run into the wellbore in Box 1120.

The method 1100 also includes the step of locating the perforating tool. This is seen at Box 1140. The perforating tool is located at a selected depth along a tubular body within the wellbore. Subsurface formation 1055 of FIG. 10 is an example of a location or depth for the perforating tool, although the operator will choose specific total depths for perforation and clean-out. Thus, the term "depth" includes "total depth" along a horizontal wellbore.

The method 1100 further includes injecting a working fluid down a coiled tubing string. This is provided at Box 1150. The fluid is a hydraulic fluid that is pumped into the wellbore under pressure. The fluid is pumped down the coiled tubing and into the bore of the tubular housing making up the perforating tool at a first flow rate. The first flow rate is below an activation rate. The pumping at the first flow rate causes the pumped fluid to flow through the mandrel, through the radial flow ports of the mandrel, into the annular area, around the plunger and through the seat.

The method 1100 also includes further injecting the working fluid down the coiled tubing and into the bore of the tubular housing at a second flow rate. This is shown at Box 1160. The second flow rate is higher than the first flow rate. In this instance, the higher flow rate increases a hydraulic force acting on a pressure shoulder of a piston, causing the mandrel and connected plunger to slide along the tubular housing such that the plunger is landed on the seat. The result is that the tool is moved into its perforating mode. In this mode, all pumped fluid flows into the bore of the tubular housing, down the mandrel, through the radially-disposed slots, into the annular area and through the lateral jetting ports.

As noted above, during the perforating mode the pumped fluid will preferably include abrasive particles such as sand. In addition, a water-soluble polymer may be used in the concentration range of about 10 pounds to about 40 pounds per 1,000 gallons of liquid. The polymer keeps the abrasive particles suspended and reduces friction pressure loss during flow of fluid through the tubing 1040. A concentration of abrasive particles may be selected depending on wellbore conditions, but normally concentrations up to about one-half pound of abrasive per gallon may be used. Chemicals such as KCl and HCl may be added to the working fluid to assure that the fluid is compatible with the reservoir rock. Preferably, the fluid pumped is filtered to minimize plugging of jetting ports 148.

To effectuate the method 1100, it is preferred that a sequencing mechanism be placed along the tubular housing. The sequencing mechanism may be a J-slot mechanism. The J-slot mechanism may be configured to cycle between three settings. Those include:

(i) a first setting wherein a pin associated with the J-slot mechanism resides in a first slot that places the plunger in a raised position in response to a biasing mechanical force exerted by a spring on the mandrel while pumping at a first rate, maintaining the perforating tool in a flow-through mode (shown in FIG. 1A);

(ii) a second setting wherein the pin moves higher in the first slot in response to the injection of fluids into the wellbore at a second increased rate, placing the plunger into an intermediate position while allowing the tool to remain in its flow-through mode (shown in FIG. 1C);

(iii) the first setting again wherein the pin resides in a second slot that returns the plunger to its raised position in response to the upward biasing force of the spring; and (iv) a third setting wherein the pin moves higher along a third slot in response to the injection of fluids into the wellbore at a second increased rate, and wherein the plunger slides from the raised position to the lowered position, placing the perforating tool in its abrasive perforating mode (shown in FIG. 2A).

It is observed that the second increased rate is an activation rate. The pump rate in both the second setting and the third setting may be higher than the activation rate.

The method 1100 may include repeating the step of Box 1150 to provide further clean-out. During this step, a rotary tool below the perforating tool such as (positive displacement motor 300A) may be activated in order to mill out a plug or other wellbore obstacle.

In one aspect of the method 1000, the perforating tool 100 is part of a bottom hole assembly that includes a downhole tool. The downhole tool is threadedly (or otherwise operatively) connected to the lower end of the lower sub. An upper end of the lower sub supports or abuts or is otherwise proximate to the seat.

In one embodiment, the downhole tool is a positive displacement motor. The positive displacement motor is configured to rotate a connected mill bit in response to hydraulic pressure received when the perforating tool is in its flow-through mode. In this instance, the method further comprises milling out a plug or debris located in the wellbore below the bottom sub using the positive displacement motor.

Milling operations may also be conducted to remove plugs that have been placed in the well bore. The operator may mill through wellbore obstacles using the flow-through mode, then switch the tool to its perforating mode to create perforations at the desired location. The tool can then be cycled back to the flow-through mode to resume circulation through the motor to circulate out the sand that was used for creating the perforations. Changing the flow path to the motor has the benefit of maintaining circulation around the entire BHA to avoid getting stuck, as well as enabling a higher pump rate than would be achievable through the perforating nozzles.

In another embodiment, the downhole tool is a sliding sleeve shifting tool. The setting tool is configured to shift a sliding sleeve along the wellbore in response to hydraulic pressure received when the perforating tool is in its flow-through mode. In this instance, the method further comprises shifting a sliding sleeve located in the wellbore below the bottom sub using the sliding sleeve shifting tool.

FIG. 3B is an example of a suitable sliding sleeve shifting tool 300B that may be used as part of a bottom hole assembly with the perforating tool 100 of FIGS. 1A and 2A. This illustrative tool 300B is a bi-directional shifting tool that is available from Hunting Energy Services, LLC of Houston, Tex.

In still another embodiment, the downhole tool is a bridge plug. The bridge plug may be either a permanently installed bridge plug or a resettable bridge plug. In this instance, the method further comprises setting the bridge plug in the wellbore below the bottom sub in response to hydraulic pressure received when the perforating tool is in its flow-through mode. In another instance the bridge plug may be set in response to movement of the conveyance tubing.

FIG. 3C presents an example of a suitable bridge plug 300C. This illustrative tool 300C is a Crownstone™ GTV tubing-retrievable well barrier (or retrievable bridge plug) that is available from Baker Hughes (a GE Company) also of Houston, Tex.

In another embodiment, the downhole too is an extended reach tool. The extended reach tool creates pressure pulses in the flow through the coiled tubing, which reduces friction between the coiled tubing and the wellbore. An operator may utilize the extended reach tool while in clean-out (that is, flow-through) mode to achieve deeper depths that would otherwise not be attainable and then switch to perforating mode to perforate the wellbore. In perforating mode, the sand laden fluid is isolated from the extended reach tool, which typically would be damaged by such fluid.

FIG. 3D resents an example of a suitable extended reach tool 300D. This illustrative tool 300D is a Toe Tapper™ extended reach tool that is available from CT Energy Ltd. of Calgary, Alberta.

Further, variations of the tool and of methods for operating a flow diverter tool may fall within the spirit of the claims, below. For example, the location of the upper 162 and lower 164 seals, and the corresponding locations of the slots 165 and the flow ports 185, may be reconfigured such that the raised position of the perforating tool 100 correlates to the perforating mode rather than the flow-through mode, and such that the lowered position correlates to the flow-through mode rather than the perforating mode.

Figure 12A:
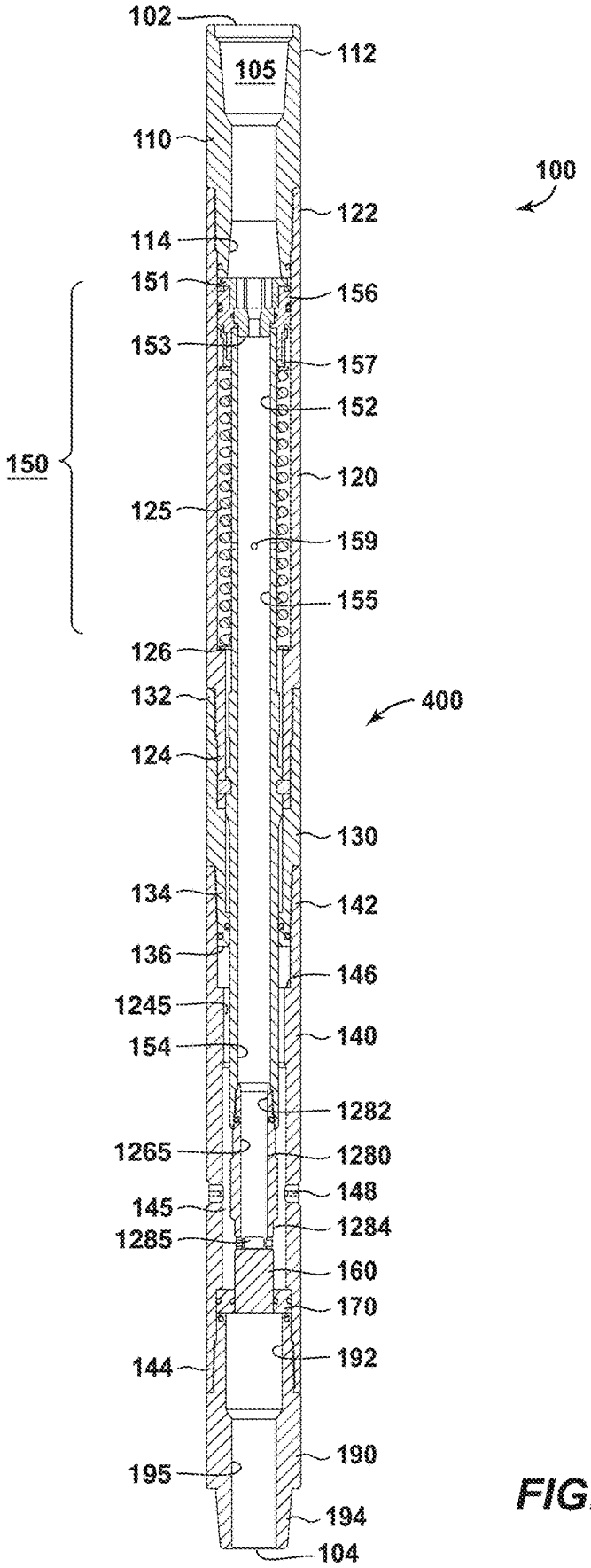
FIG. 12A is a first cross-sectional view of a perforating tool (or "flow diverter") of the present invention, in an alternate embodiment. In this view, the perforating tool is in its run-in position. This is an abrasive perforating mode, with all of the injected fluids being diverted from the tool through lateral jetting ports.
Figure 12B:
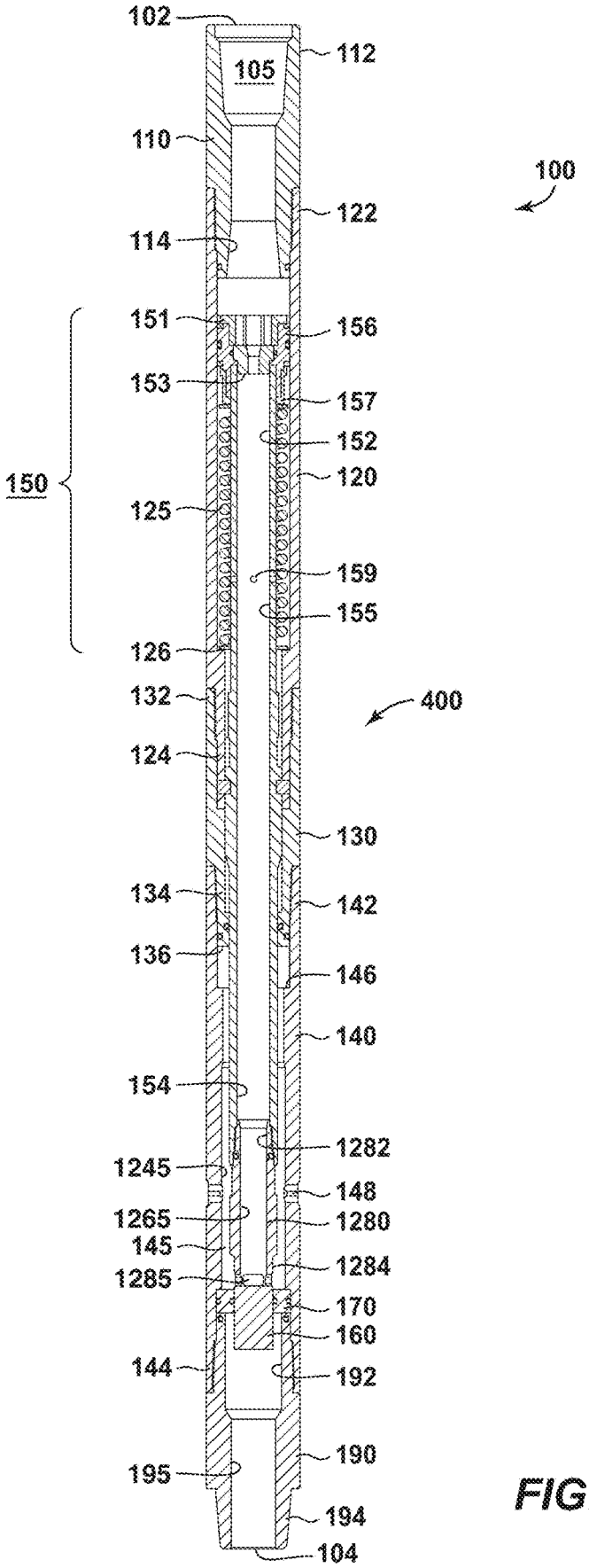
FIG. 12B is a second cross-sectional view of the perforating tool of FIG. 12A. Here, the perforating tool has been cycled to an intermediate position. In this position, the plunger has advanced partially down the tool, but all of the injected fluid continues to flow through the lateral jetting ports.
Figure 12C:
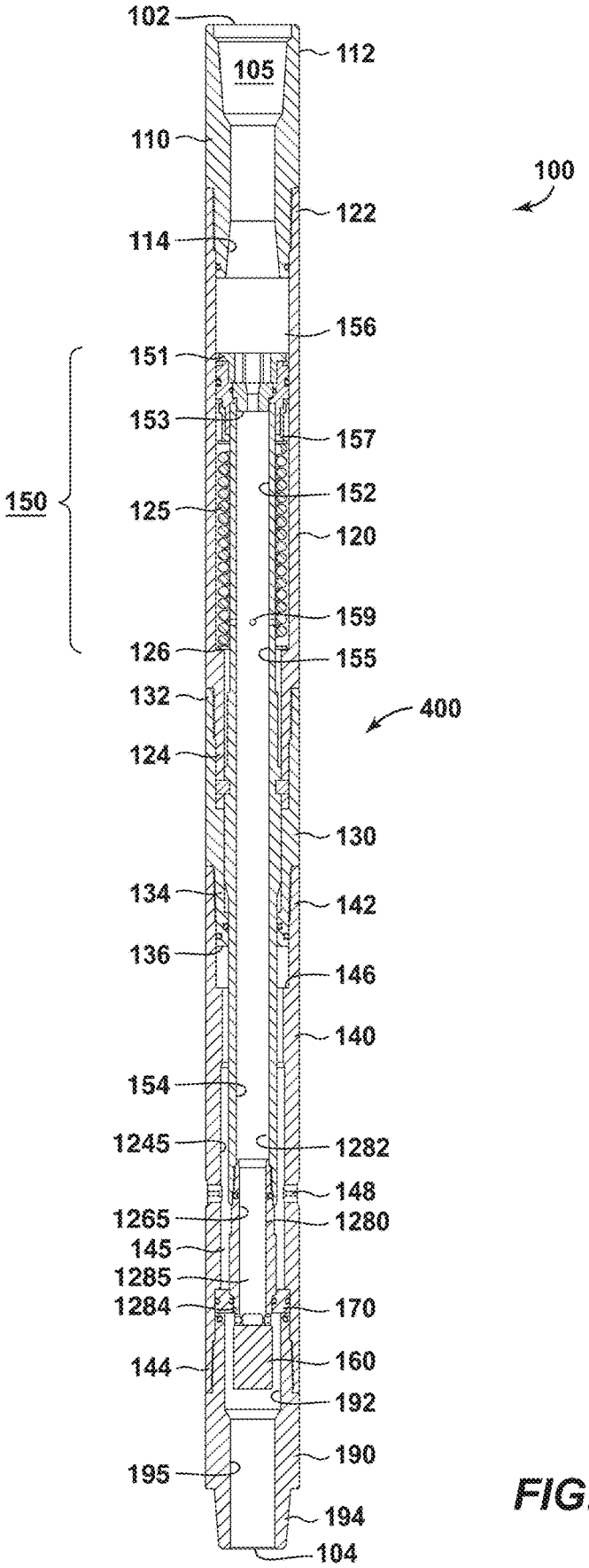
FIG. 12C is a third cross-sectional view of the perforating tool of FIG. 12A. Here, the tool has advanced to its lowered position. This is a flow-through mode where all of the injected fluid flows through a seat at the bottom of the tool.

FIGS. 12A through 12C demonstrate a perforating tool 1200 wherein the tool is biased in its abrasive perforating mode. This means that in the raised position abrasive perforating fluid is injected through lateral jetting nozzles, while in the lowered position a working fluid is entirely injected through a seat at the bottom of the perforating tool. This allows the fluid to serve as a working fluid for operating a positive displacement motor 300A or for activating a sliding sleeve 300B or for setting a bridge plug 300C in the wellbore.

FIG. 12A is a first cross-sectional view of the perforating tool (or "flow diverter") 1200. In this view, the perforating tool 1200 is in an abrasive perforating mode. Here, all of the injected fluids are diverted from the tool 1200 and through lateral jetting ports 1248. Thus, the tool 1200 is spring-biased to the abrasive perforating mode rather than to the flow-through mode.

The perforating tool 1200 defines a generally tubular body formed from a series of components. As shown, the perforating tool 1200 has a first (or upstream) end 102 and a second (or downstream) end 104. A central bore 105 is formed within the body extending from the first end 102 to the second end 104.

As with clean-out tool 100 described above, the perforating tool 1200 is configured to cycle a position of a mandrel 155 and connected plunger 160 in response to fluid pumping rates into the wellbore 1000 by an operator. In this way, a flow of fluid through the tool 1200 may be adjusted. In the view of FIG. 12A, the perforating tool 1200 is in its run-in position wherein all the injected fluid flows through the tool 1200 from the top (or upstream) end 102, then out through side ports 1285 and into an annular area 1245, then through lateral jetting ports 1248. Of interest, the lowered end of the plunger 160 has no through-bore and is sealingly inserted in a seat 170, preventing the injected fluids from flowing through the bottom end 104 of the tool 1200.

It is observed here that some of the tubular components in the perforating tool 1200 correspond to components of the perforating tool 100, or at least very closely there to. Examples include the top sub 110, the piston assembly 150, the spring housing 120 and spring 125, the upper mandrel seal sub 130, the jetting port housing 140 with one or more jetting ports 148, the mandrel 155 and the bottom sub 190. Accordingly, those components need not be described again here.

The spring housing 120, the mandrel seal sub 130 and the jetting housing 140 together make up a tubular housing for the perforating tool 1200. Of interest, a shoulder 146 resides along an inner diameter of the jetting port housing 140. The shoulder 146 forms a profile above the jetting ports 148. A separate shoulder 136 resides at the bottom end 134 of the mandrel seal sub 130. O-rings are placed inside the bottom end 134, helping to keep perforating fluid from flowing from an annular area between the mandrel 155 and the spring housing 120 during perforating.

An annular area 145 is reserved between the mandrel 155 and the surrounding jetting port housing 140. The annular area 145 has an upper portion where the spring 125 resides, and a lower portion where jetting ports 148 are placed. Appropriate o-rings reside around and inside the downstream end 134 of the mandrel seal sub 130 to provide a fluid seal between the upper and lower annular regions 145. The annular region the spring 125 resides in is pressure balanced via ports 159 in the mandrel 155. These ports 159 let the fluid volume inside the spring housing 120 change as the piston body 156 moves up and down.

At the lower end 154 of the mandrel 155 is a stem 1280. The stem 1280 defines a short tubular body having an upper (or upstream) end 1282 and an opposing lower (or downstream) end 1284. A bore 1265 is formed from the upper 1282 to the lower 1284 end, allowing working fluids to flow through the side ports 1285. Preferably, two or more equiradially disposed slots are provided for the side ports 1285. The upper end 1282 comprises male threads that connect to the lower end 154 of the mandrel 155. In this way, the stem 1280 moves up and down along the bore 105 of the perforating tool 1200 with the mandrel 155.

The lower end 1284 of the stem 1280 is connected to a plunger 160. As noted above, the plunger 160 is a solid body that may be fabricated from plastic, steel or an elastomeric material. In this instance, the plunger 160 is dimensioned to move through a seat 170. Appropriate seals are provided along the I.D. of the seat 170 to prevent fluids from bypassing the plunger 160.

In the raised position of FIG. 1A, fluid is injected by an operator into the bore 105 of the perforating tool 1200 under a first pressure. The first pressure correlates to a first flow rate. Those of ordinary skill in the art will understand that there is a correlation between flow rate, tubular dimension and pressure. At the first flow rate, the hydraulic pressure acting on the piston assembly 150 is not great enough to cause the piston assembly 150 to compress the spring 125.

FIG. 12B is a second cross-sectional view of the perforating tool 1200 of FIG. 12A. Here, the perforating tool 1200 has been cycled to an intermediate position. Stated another way, the perforating tool 1200 is translating (that is, sliding down the spring housing 120) to its intermediate position. This is done by increasing the hydraulic force acting on the piston assembly 150. In this position, the plunger 160 has advanced partially down the tool 1200, but all of the injected fluid continues to flow through the lateral jetting ports 148.

FIG. 12C is a third cross-sectional view of the perforating tool 1200 of FIG. 12A. Here, the tool 1200 (or the plunger 160 in the tool 1200) has advanced to its lowered position. This is a flow-through mode where all of the injected fluid flows through the side ports 1285 below the seat 170. Advancing the plunger 160 is done by further increasing the pump rate above an activation rate, thereby increasing the hydraulic force acting on the shoulder that is the piston assembly 150.

The cycling of the tool 1200 between its raised position (FIG. 12A), its intermediate position (FIG. 12B) and its lowered position (FIG. 12C) is preferably accomplished by using a sequencing mechanism. The sequencing mechanism is preferably the J-slot mechanism as shown in FIGS. 4A-4D, discussed above. The sequencing mechanism 400 allows the operator to cycle the flow rates to move the tool 1200 between settings so that:

(i) in a first setting, the plunger 160 is in a raised position in response to the biasing mechanical force exerted by the spring 125 on the mandrel 155, placing the perforating tool in an abrasive perforating mode;

(ii) in a second setting, pumping rate is increased and the J-slot mechanism 400 advances to a next slot, allowing the plunger 160 to move down no more than to its intermediate position and allowing the operator to inject hydraulic fluid (typically the perforating fluid) into the bore 105 of the tubular housing 110 and through the piston orifice 153 at a second rate, or at any rate higher than the second rate, and keeping the perforating tool 1200 in its abrasive perforating mode;

(iii) in the first setting again, hydraulic pumping rate is reduced to its first rate, or any rate below the first rate, and the perforating tool 1200 remains in its perforating mode; and (iv) in a third setting, the plunger 160 is forced through the seat 170 in response to the injection of hydraulic fluid through the piston assembly 150 and into the perforating tool 1200 at a second rate, or at any rate higher than the second rate, moving the J-slot mechanism 400 to a next slot and causing the plunger 160 to slide from the raised position to the lowered position, placing the perforating tool 1200 in its flow-through mode.

Using the perforating tool 1200 of FIGS. 12A-12C, a method of cleaning out a wellbore is also provided herein. The wellbore may be the wellbore 1000 of FIG. 10, for example. In one aspect, the method includes the steps of:

(a) placing a perforating tool in the wellbore along a string of production casing;

(b) locating the perforating tool and connected downhole tool within the wellbore;

(c) pumping working fluid down the wellbore and into the perforating tool at or above an activation rate, causing the tubular mandrel and connected plunger to move through a seat to a lowered position such that all fluid flows through the perforating tool (a flow-through mode);

(d) lowering the pumping rate to advance the J slot pins to the next setting, therefore placing the tool in its perforating mode;

(e) pumping the working fluid down the wellbore and into the perforating tool at a rate at or above the activation rate such that all fluid flows through lateral jetting ports (a perforating mode); and (f) continuing to pump the working fluid down the wellbore and into the perforating tool at a rate at or above the activation rate in order to hydraulically perforate a surrounding string of production casing.

In one aspect of the method, the perforating tool is part of a bottom hole assembly that includes a downhole tool. The downhole tool is threadedly (or otherwise operatively) connected to the lower end of the lower sub. An upper end of the lower sub supports the seat.

In one embodiment, the downhole tool is a positive displacement motor. The positive displacement motor is configured to rotate a connected mill bit in response to hydraulic pressure received when the perforating tool is in its flow-through mode. In this instance, the method further comprises milling out a plug or debris located in the wellbore below the bottom sub using the positive displacement motor.

In another embodiment, the downhole tool is a sliding sleeve shifting tool. The setting tool is configured to shift a sliding sleeve along the wellbore in response to hydraulic pressure received when the perforating tool is in its flow-through mode. In this instance, the method further comprises shifting a sliding sleeve located in the wellbore below the bottom sub using the sliding sleeve shifting tool.

In still another embodiment, the downhole tool is a bridge plug. The bridge plug may be either a permanently installed bridge plug or a resettable bridge plug. In one instance, the method further comprises setting the bridge plug in the wellbore below the bottom sub in response to hydraulic pressure received when the perforating tool is in its flow-through mode. In another instance, the method further comprises setting the bridge plug in the wellbore below the bottom sub in response to movement of the conveyance tubing.

In another embodiment, the downhole too is an extended reach tool. The extended reach tool creates pressure pulses in the flow through the coiled tubing, which reduces friction between the coiled tubing and the wellbore. An operator may utilize the extended reach tool while in flow-through mode to achieve deeper depths that would otherwise not be attainable and then switch to perforating mode to perforate the wellbore. In perforating mode, the sand laden fluid is isolated from the extended reach tool, which typically would be damaged by such fluid.

It will be appreciated that the inventions are susceptible to other modifications, variations and changes without departing from the spirit thereof.

We claim:

1. A multi-cycle perforating tool for controlling a direction of a working fluid within a wellbore, the wellbore having been lined with a string of production casing, and the perforating tool comprising:

a tubular housing providing an elongated bore through which a working fluid may be injected, the tubular housing having one or more lateral jetting ports;

a piston disposed proximate an upstream end of the housing, the piston forming a pressure shoulder and having an orifice configured to deliver the working fluid from a wellbore conveyance tubing into the elongated bore of the housing;

a tubular mandrel slidably positioned within the housing, the tubular mandrel having a proximal end connected to or acted upon by the piston, and a distal end forming a plunger; and a seat disposed along the tubular housing below the distal end of the tubular mandrel, the seat being configured to receive the plunger when the piston and connected mandrel slide from a raised position to a lowered position along the tubular housing, and the seat providing a central flow-through opening for receiving the working fluid;

an annular region formed between the tubular mandrel and the surrounding tubular housing;

one or more slots residing along the tubular mandrel; and one or more flow ports also residing along the tubular mandrel, but below the one or more slots;

and wherein the perforating tool is configured to cycle a position of the tubular mandrel and connected plunger in response to changes in fluid pumping rate into the conveyance tubing such that (i) all fluid flows through the flow-through opening in the seat when the tubular mandrel and connected plunger are in the raised position, and (ii) all fluid flows through the jetting ports when the tubular mandrel and connected plunger are in the lowered position.

2. The perforating tool of claim 1, wherein:

the plunger comprises a solid body that is mechanically or adhesively connected to the distal end of the mandrel;

the tubular housing comprises a spring housing having an internal shoulder; and the perforating tool further comprises a spring residing within the spring housing, with an upper end of the spring acting against the piston, biasing the tool in its raised position.

3. The perforating tool of claim 2, wherein the tubular housing further comprises:

an upper sub having a first upper end and a second lower end, wherein the lower end is threadedly connected to an upper end of the spring housing; and a lower sub having a first upper end and a lower end, with the lower end being threadedly connected to a downhole tool.

4. The perforating tool of claim 3, wherein the downhole tool is (i) a positive displacement motor, (ii) a resettable bridge plug, (iii) a sliding sleeve shifting tool, or (iv) an extended reach tool.

5. The perforating tool of claim 2, further comprising:

an upper seal residing along an inner diameter of the tubular housing, and a separate lower seal also residing along the inner diameter of the tubular housing, wherein the upper and lower seals straddle the jetting ports;

and wherein:

when the perforating tool is in its raised position, the working fluid exits the mandrel through the flow ports, but the lower seal prevents working fluid from flowing up the annular region and to the jetting ports, thereby forcing all of the working fluid to flow around the plunger and through the seat; and when the perforating tool is in its lowered position, the working fluid exits the mandrel through the slots, and the upper and lower seals confine all of the working fluid to flow through the jetting ports.

6. The perforating tool of claim 5, wherein:

the one or more slots comprises a plurality of radially-disposed slots; and the one or more flow ports comprises a plurality of radially disposed flow ports placed along the mandrel below the slots.

7. The perforating tool of claim 6, wherein:

the wellbore further comprises a string of production tubing; and the perforating tool is dimensioned to be run into or through the string of production tubing.

8. The perforating tool of claim 5, wherein:

the spring resides between the tubular mandrel and the surrounding tubular housing above the internal shoulder, the spring being pre-loaded in compression to bias the tubular mandrel and connected plunger in a position above the seat; and a sequencing mechanism comprising a cylindrical body, wherein the sequencing mechanism is responsive to a sequence of the fluid pumping rates applied above the piston.

9. The perforating tool of claim 8, wherein the sequencing mechanism is configured to cycle the mandrel between:

its raised position wherein the perforating tool is in a flow-through mode;

an intermediate position wherein the perforating tool remains in its flow-through mode, and its lowered position wherein the perforating tool is in a perforating mode.

10. The perforating tool of claim 9, wherein:

the sequencing mechanism is a J-slot sequencing mechanism;

the J-slot sequencing mechanism resides above the slots and the flow ports;

the J-slot sequencing mechanism cooperates with at least one pin disposed along the tubular housing configured to ride in slots along the cylindrical body to cycle the mandrel and connected plunger between the raised position, the intermediate position and the lowered position;

and wherein the pin is fixed from axial movement and rides in J-slots of the mandrel to restrict axial movement of the mandrel on alternating downward strokes.

11. The perforating tool of claim 10, wherein the J-slot mechanism and spring are configured to:

(i) maintain the mandrel and connected plunger in a raised position while pumping at or below a first pump rate;

(ii) maintain the mandrel and connected plunger in an intermediate position while increasing pump rate above the first pump rate, wherein the perforating tool remains in its flow-through mode;

(iii) upon dropping the pump rate back down to or below the first pump rate, release the mandrel and connected plunger back to the raised position;

(iv) upon raising the pump rate to a rate that meets or exceeds a second pump rate, move the mandrel and connected plunger to a lowered position, placing the perforating tool in its perforating mode; and (v) repeat the cycle of steps (i) through (iv).

12. The perforating tool of claim 10, wherein the J-slot mechanism is configured to cycle between three settings, comprising:

(i) a first setting wherein the pin resides in a first slot that places the plunger in the raised position in response to the biasing mechanical force exerted by the spring on the mandrel while pumping at a first rate;

(ii) a second setting wherein the pin moves higher in the first slot in response to the injection of the working fluid into the conveyance tubing at an increased pump rate, placing the plunger in an intermediate position;

(iii) the first setting again wherein the pin resides in a second slot that returns the plunger to its raised position in response to the biasing mechanical force exerted by the spring; and (iv) a third setting wherein the pin moves higher in a third slot in response to the injection of the working fluid into the conveyance tubing at a second increased rate, or at any rate higher than the second rate, and wherein the plunger slides from the raised position to the lowered position.

13. A method of cleaning out a wellbore using a perforating tool, the wellbore having been lined with a string of casing along a selected subsurface formation, and the method comprising:

running a perforating tool into the wellbore on a lower end of a working string, the perforating tool comprising:

a tubular housing providing an elongated bore through which fluids are injected, the tubular housing having one or more lateral jetting ports;

a piston disposed proximate an upstream end of the housing, the piston forming a pressure shoulder and having at least one orifice configured to deliver working fluid from the working string to the elongated bore of the housing;

a tubular mandrel slidably positioned within the housing, the mandrel having a proximal end connected to or acted upon by the piston, and a distal end forming a plunger;

an annular region formed between the mandrel and the surrounding tubular housing;

one or more slots residing along the mandrel;

one or more flow ports also residing along the mandrel, but below the one or more slots; and a seat disposed along the tubular housing below the distal end of the tubular mandrel, the seat being dimensioned to sealingly receive the plunger when the piston and connected tubular mandrel slide from a raised position to a lowered position along the tubular housing, and the seat providing a central flow-through opening for receiving the working fluid;

locating the perforating tool at a selected depth along the wellbore;

injecting working fluid down the coiled tubing and into the bore of the tubular housing at a first flow rate, thereby causing all of the working fluid to flow through the mandrel, through flow ports in the mandrel, around the plunger and through the flow-through opening in the seat; and further injecting the working fluid down the coiled tubing and into the bore of the tubular housing at a second flow rate that is higher than the first flow rate, thereby increasing a hydraulic force acting on the pressure shoulder of the piston and causing the mandrel and connected plunger to slide along the tubular housing such that the plunger moves from a raised position above the seat to a lowered position where the plunger is landed on the seat, thereby forcing all of the injected working fluid to flow through slots in the mandrel and through the lateral jetting ports.

14. The method of claim 13, wherein injecting the working fluid through the lateral jetting ports abrasively perforates the production casing.

15. The method of claim 14, wherein:

the plunger comprises a solid body that is operatively connected to the distal end of the mandrel;

the tubular housing comprises a spring housing having an internal shoulder; and the perforating tool further comprises a spring residing within the spring housing, with an upper end of the spring acting against the piston, biasing the plunger in its raised position.

16. The method of claim 15, wherein the tubular housing further comprises:

an upper sub having a first upper end and a second lower end, wherein the lower end is threadedly connected to an upper end of the spring housing; and a lower sub having a first upper end and a lower end, with the lower end being threadedly connected to a downhole tool.

17. The method of claim 16, wherein the downhole tool is (i) a positive displacement motor, (ii) a resettable bridge plug, (iii) a sliding sleeve shifting tool, or (iv) an extended reach tool.

18. The method of claim 15, wherein:

the downhole tool is a sliding sleeve shifting tool; and the method further comprises:

placing the perforating tool in a flow-through mode wherein all working fluid flows through the mandrel, through flow ports in the mandrel, around the plunger, through the flow-through opening in the seat and to the sliding sleeve shifting too; and shifting a sliding sleeve associated with the sliding sleeve shifting tool in the wellbore.

19. The method of claim 15, wherein the perforating tool further comprises:

an upper seal residing along an inner diameter of the tubular housing, and a separate lower seal also residing along the inner diameter of the tubular housing, wherein the upper and lower seals straddle the jetting ports;

and wherein:

when the perforating tool is in its raised position, the working fluid exits the mandrel through the flow ports, but the lower seal prevents working fluid from flowing up the annular region and to the jetting ports, thereby forcing all of the working fluid to flow around the plunger and through the seat; and when the perforating tool is in its lowered position, the working fluid exits the mandrel through the slots, and the upper and lower seals confine all of the working fluid to flow through the lateral jetting ports.

20. The method of claim 15, wherein:

the one or more slots comprises a plurality of radially-disposed slots; and the one or more flow ports comprises a plurality of radially disposed flow ports.

21. The method of claim 20, wherein:

the spring resides between the tubular mandrel and the surrounding tubular housing above the internal shoulder, the spring being pre-loaded in compression to bias the mandrel and connected plunger in a position above the seat; and a sequencing mechanism comprising a cylindrical body, wherein the sequencing mechanism is responsive to a sequence of the fluid pumping rates applied above the piston.

22. The method of claim 14, wherein the sequencing mechanism is configured to cycle the mandrel and connected plunger between:

the raised position wherein the perforating tool is in a flow-through mode;

an intermediate position wherein the perforating tool remains in its flow-through mode, and the lowered position wherein the perforating tool is in a perforating mode.

23. The method of claim 22, wherein the sequencing mechanism is a J-slot sequencing mechanism;

the J-slot sequencing mechanism resides above the slots and the flow ports;

the J-slot sequencing mechanism cooperates with at least one pin disposed along the tubular housing configured to ride in slots along the cylindrical body to cycle the mandrel and connected plunger between the raised position, the intermediate position and the lowered position;

and wherein the pin is fixed from axial movement and rides in the J-slots of the mandrel to restrict axial movement of the mandrel on alternating downward strokes.

24. The method of claim 23, wherein the J-slot mechanism and spring are configured to:

(i) maintain the mandrel and connected plunger in a raised position while pumping at or below a first pump rate;

(ii) maintain the mandrel and connected plunger in an intermediate position while increasing pump rate above the first pump rate, wherein the perforating tool remains in its flow-through mode;

(iii) upon dropping the pump rate back down to or below the first pump rate, return the mandrel and connected plunger back to the raised position;

(iv) upon raising the pump rate to a rate that meets or exceeds a second pump rate, move the mandrel and connected plunger to a lowered position, placing the perforating tool in its perforating mode; and (v) repeat the cycle of steps (i) through (iv).

25. The method of claim 24, wherein step (v) is done without reverse circulating in the wellbore.

26. The method of claim 23, wherein the J-slot mechanism and spring are configured to cycle between three settings, comprising:

(i) a first setting wherein the pin resides in a first slot that places the plunger in the raised position in response to the biasing mechanical force exerted by the spring on the mandrel while pumping at a first rate;

(ii) a second setting wherein the pin moves higher in the first slot in response to the injection of the working fluid into the conveyance tubing at an increased pump rate, placing the plunger in an intermediate position;

(iii) the first setting again wherein the pin resides in a second slot that returns the plunger to its raised position in response to the biasing mechanical force exerted by the spring; and (iv) a third setting wherein the pin moves higher in a third slot in response to the injection of the working fluid into the conveyance tubing at a second increased rate, or at any rate higher than the second rate, and wherein the plunger slides from the raised position to the lowered position.

27. The method of claim 23, further comprising:

adjusting an aperture size of the orifice associated with the piston, thereby accommodating flow rate variations associated with the raised and lowered positions arising from changes in mandrel dimensions.

28. The method of claim 27, further comprising:

selecting a cross-sectional area of the piston orifice, selecting a cross-sectional area of the one or more jetting ports;

selecting a cross-sectional area of the slots in the mandrel;

selecting a cross-sectional area of the flow ports in the mandrel;

selecting a cross-sectional area of the flow-through opening in the seat; or combinations thereof, before running the perforating tool into the wellbore.

29. The method of claim 23, further comprising:

monitoring a pressure of the working fluid from the surface as it is injected into the tubular housing; and receiving confirmation that the perforating tool has entered its perforating mode when pressure reaches a designated level.

30. A method of operating a perforating tool in a wellbore, comprising:

(a) placing a perforating tool in the wellbore along a string of production casing;

(b) locating the perforating tool and a connected downhole tool within the wellbore;

(c) pumping working fluid down the wellbore and into the perforating tool at or above an activation rate, causing a tubular mandrel and connected plunger to move to a lowered position on a seat such that all of the working fluid flows through lateral jetting ports;

(d) continuing to pump the working fluid down the wellbore and into the perforating tool at a rate above an activation rate in order to hydraulically perforate a surrounding string of production casing, wherein all of the pumped fluid flows through the jetting ports in a perforating mode; and (e) pumping the fluid down the wellbore and into the perforating tool at a rate below the activation rate such that all fluid flows through the flow-through opening in the seat in a flow-through mode.

31. The method of claim 30, wherein the perforating tool comprises:

a tubular housing providing an elongated bore through which the working fluid is injected, the tubular housing containing the lateral jetting ports;

a piston disposed at an upstream end of the housing, the piston forming a pressure shoulder and having an orifice configured to deliver working fluid from a conveyance string to the elongated bore of the housing;

a tubular mandrel slidably positioned within the housing, the mandrel having a proximal end connected to or acted upon by the piston, and a distal end forming a plunger;

a seat disposed along the tubular housing below the distal end of the tubular mandrel, the seat being dimensioned to receive the plunger when the piston and connected mandrel slide from a raised position to a lowered position within the tubular housing, and the seat providing a central flow-through opening for receiving the working fluid; and a lower sub having a first upper end proximate to the seat, and a lower end operatively connected to a downhole tool.

32. The method of claim 31, wherein:

the downhole tool is a positive displacement motor, with the positive displacement motor being configured to rotate a connected mill bit in response to hydraulic pressure received when the perforating tool is in its flow-through mode; and the method further comprises milling out a bridge plug or debris located in the wellbore below the bottom sub using the positive displacement motor.

33. The method of claim 31, wherein:

the downhole tool is a shifting tool, with the shifting tool being configured to shift a sliding sleeve along the wellbore in response to hydraulic pressure received when the perforating tool is in its flow-through mode; and the method further comprises shifting a sliding sleeve located in the wellbore below the bottom sub using the shifting tool.

34. The method of claim 31, wherein:

the downhole tool is a bridge plug; and the method further comprises setting the bridge plug in the wellbore below the bottom sub in response to hydraulic pressure received when the perforating tool is in its flow-through mode.

35. The method of claim 31, wherein the perforating tool further comprises:

an annular region formed between the mandrel and the surrounding tubular housing;

one or more slots residing along the mandrel;

one or more flow ports also residing along the mandrel, but below the slots; and an upper seal residing along an inner diameter of the tubular housing, and a separate lower seal also residing along the inner diameter of the tubular housing, wherein the upper and lower seals straddle the jetting ports;

and wherein:

when the perforating tool is in its flow-through mode, the working fluid exits the mandrel through the flow ports, but the lower seal prevents working fluid from flowing up the annular region and to the jetting ports, thereby forcing all of the working fluid to flow around the plunger and to the seat; and when the perforating tool is in its perforating mode, the working fluid exits the mandrel through the slots, and confines all of the working fluid to flow through the jetting ports.

36. A perforating tool for controlling a direction of a working fluid within a wellbore, the wellbore having been lined with a string of production casing, and the perforating tool comprising:

a tubular housing providing an elongated bore through which fluids may be injected, the tubular housing having one or more lateral jetting ports;

a piston disposed proximate an upstream end of the housing, the piston forming a pressure shoulder and having an orifice configured to deliver the working fluid from a wellbore conveyance tubing into the elongated bore of the housing;

a tubular mandrel slidably positioned within the housing, the mandrel having a proximal end connected to or acted upon by the piston, and a distal end forming a plunger;

one or more flow ports; and a seat disposed along the tubular housing and having a through-opening, the through-opening being configured to slidably receive the plunger when the piston and connected mandrel slide from a raised position to a lowered position along the tubular housing;

and wherein the perforating tool is configured to cycle a position of the mandrel and connected plunger in response to changes in fluid pumping rate into the conveyance tubing such that (i) all working fluid flows through the flow ports in the mandrel and out of the lateral jetting ports in the tubular housing above the seat when the mandrel and connected plunger are in the raised position, and (ii) all working fluid flows through the flow ports and out of the tubular housing below the seat when the mandrel and connected plunger are in the lowered position.

37. The perforating tool of claim 36, wherein:

the plunger comprises a solid body that is operatively connected to the distal end of the mandrel;

the tubular housing comprises a spring housing having an internal shoulder; and the perforating tool further comprises a spring residing within the spring housing, with an upper end of the spring acting against the piston, biasing the tool in its raised position.

38. The perforating tool of claim 37, wherein the tubular housing further comprises:

an upper sub having a first upper end and a second lower end, wherein the lower end is threadedly connected to an upper end of the spring housing; and a lower sub having a first upper end and a lower end, with the lower end being operatively connected to a downhole tool.

39. The perforating tool of claim 38, wherein:

the perforating tool further comprises a tubular stem;

an upper end of the stem is threadedly connected to a lower end of the mandrel;

the plunger resides at a lower end of the stem; and the one or more flow ports comprises two or more flow ports radially disposed around the stem proximate to and above the plunger.

40. The perforating tool of claim 39, wherein the downhole tool is (i) a positive displacement motor, (ii) a bridge plug, or (iii) and extended reach tool.

41. A method of operating a perforating tool in a wellbore, the perforating tool comprising:

a tubular housing providing an elongated bore through which the fluid is injected, the tubular housing containing the lateral jetting ports;

a piston disposed at an upstream end of the housing, the piston forming a pressure shoulder and having an orifice configured to deliver working fluid from a conveyance string to the elongated bore of the housing;

a tubular mandrel slidably positioned within the housing, the mandrel having a proximal end connected to or acted upon by the piston, and a distal end forming a plunger;

one or more flow ports disposed along the mandrel; and a seat disposed along the tubular housing and having a through-opening, the through-opening being configured to slidably receive the plunger when the piston and connected mandrel slide from a raised position to a lowered position along the tubular housing, and the method comprising:

(a) placing the perforating tool in the wellbore along a string of production casing;

(b) locating the perforating tool and a connected downhole tool within the wellbore;

(c) pumping fluid down the wellbore and into the perforating tool at or above an activation rate, causing the one or more flow ports and the plunger to move through a seat to a lowered position such that all fluid flows through the perforating tool as a flow-through mode, and through the seat;

(d) lowering a pumping rate of the fluid, causing the mandrel and connected plunger to move up the tubular housing so that the one or more flow ports and the plunger are above the seat;

(e) pumping a perforating fluid down the wellbore and into the perforating tool at a rate at or above the activation rate such that all fluid flows through the one or more flow ports and out of the lateral jetting ports as a perforating mode; and (e) continuing to pump the perforating fluid down the wellbore and into the perforating tool at a rate at or above the activation rate in order to hydraulically perforate a surrounding string of production casing.

42. The method of claim 41, wherein:

when the tubular mandrel and connected plunger are in the raised position, the plunger resides adjacent to the seat, and the one or more flow ports reside above the seat and are in fluid communication with the lateral jetting ports; and when the tubular mandrel and connected plunger slide down through the through-opening in the seat, the one or more flow ports and the plunger reside below the seat.

43. The method of claim 42, wherein the perforating tool further comprises:

a lower sub having a first upper end proximate to the seat, and a lower end operatively connected to a downhole tool.

44. The method of claim 43, wherein:

the downhole tool is a positive displacement motor, with the positive displacement motor being configured to rotate a connected mill bit in response to hydraulic pressure received when the perforating tool is in its flow-through mode; and the method further comprises milling out a bridge plug or debris located in the wellbore below the bottom sub using the positive displacement motor.

45. The method of claim 43, wherein:

the downhole tool is a shifting tool, with the shifting tool being configured to shift a sliding sleeve along the wellbore in response to hydraulic pressure received when the perforating tool is in its flow-through mode; and the method further comprises shifting a sliding sleeve located in the wellbore below the bottom sub using the shifting tool.

46. The method of claim 43, wherein:

the downhole tool is a bridge plug; and the method further comprises setting the bridge plug in the wellbore below the bottom sub in response to hydraulic pressure received when the perforating tool is in its flow-through mode.

47. The method of claim 43, wherein:

the downhole tool is a bridge plug; and the method further comprises setting the bridge plug in the wellbore below the bottom sub in response to movement of the conveyance tubing.

48. The method of claim 43, wherein:

the downhole tool is an extended reach tool, with the extended reach tool being configured to generate fluid pressure pulses in response to hydraulic pressure received when the perforating tool is in its flow-through mode; and the method further comprises reducing coiled tubing friction by generating fluid pressure pulses below the bottom sub using the extended reach tool.

* * * * *